US006705979B1

(12) United States Patent
Sakaguchi et al.

(10) Patent No.: US 6,705,979 B1
(45) Date of Patent: Mar. 16, 2004

(54) METHOD OF AND APPARATUS FOR MACHINING WEB-SHAPED WORKPIECE AND APPARATUS FOR PROCESSING SCRAP

(75) Inventors: Masaaki Sakaguchi, Kanagawa-ken (JP); Kazumasa Harada, Minamiashigara (JP); Shuji Nakata, Minamiashigara (JP); Masayoshi Sekino, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/461,037

(22) Filed: Dec. 15, 1999

Related U.S. Application Data

(62) Division of application No. 09/021,998, filed on Feb. 11, 1998.

(30) Foreign Application Priority Data

Feb. 17, 1997 (JP) ..... 9-32347
Mar. 4, 1997 (JP) ..... 9-49460

(51) Int. Cl.[7] ..... B31B 1/14
(52) U.S. Cl. ..... 493/82; 493/83; 493/373
(58) Field of Search ..... 72/254, 255, 256; 413/8; 493/82, 83, 373

(56) References Cited

U.S. PATENT DOCUMENTS

| | | | | |
|---|---|---|---|---|
| 3,589,221 A | | 6/1971 | Deegan | 83/41 |
| 3,802,307 A | | 4/1974 | Oggoian | |
| 3,910,775 A | | 10/1975 | Jackman | |
| 3,969,173 A | | 7/1976 | Amberg et al. | |
| 3,980,297 A | * | 9/1976 | Bulso et al. | 271/269 |
| 4,070,854 A | * | 1/1978 | Marino | |
| 4,295,842 A | * | 10/1981 | Bell | |
| 4,373,370 A | | 2/1983 | Allen et al. | 72/349 |
| 4,454,743 A | | 6/1984 | Bulso et al. | 72/349 |
| 4,633,720 A | | 1/1987 | Dybel et al. | |
| 4,750,131 A | | 6/1988 | Martinez | |
| 4,815,644 A | | 3/1989 | Garrick et al. | 225/97 |
| 4,846,033 A | | 7/1989 | Uehlinger et al. | |
| 4,939,918 A | | 7/1990 | Schoch | |
| 4,943,271 A | | 7/1990 | Focke et al. | |
| 5,052,993 A | | 10/1991 | Focke | |
| 5,154,689 A | * | 10/1992 | Modoux et al. | |
| 5,197,938 A | * | 3/1993 | Chmielewski | |
| 5,219,108 A | * | 6/1993 | Mineki | |
| 5,249,946 A | | 10/1993 | Marx | |
| 5,475,917 A | | 12/1995 | Biagiotti | 29/822 |
| 5,577,989 A | | 11/1996 | Neary | |
| 5,697,243 A | | 12/1997 | Ueda et al. | 72/337 |
| 5,707,196 A | * | 1/1998 | Brucker | |
| 5,820,326 A | | 10/1998 | Melson | |
| 5,826,317 A | | 10/1998 | Oostrom et al. | |
| 6,027,436 A | * | 2/2000 | Sakaguchi et al. | |

* cited by examiner

*Primary Examiner*—Eugene Kim
(74) *Attorney, Agent, or Firm*—Sughrue Mion, PLLC

(57) ABSTRACT

An apparatus for machining a web-shaped workpiece includes a workpiece supply for supplying workpiece rolls each of an elongate thin metal sheet, a processing machine for machining the elongate thin metal sheet into caps, a workpiece feeder for feeding the elongate thin metal sheet to the processing machine, and a product feeder for automatically separating the caps from scrap and feeding the caps to a product collecting mechanism. The apparatus is capable of efficiently and quickly producing various products from the elongate thin metal sheet.

10 Claims, 21 Drawing Sheets

METHOD OF AND APPARATUS FOR MACHINING WEB-SHAPED WORKPIECE AND APPARATUS FOR PROCESSING SCRAP

BACKGROUND OF THE INVENTION

This is a divisional of application Ser. No. 09/021,998 filed Feb. 11, 1998, the disclosure of which is incorporated herein by reference.

FIELD OF THE INVENTION

The present invention relates to a method of and an apparatus for machining a web-shaped workpiece into a plurality of products, and an apparatus for processing scrap produced from such a web-shaped workpiece.

DESCRIPTION OF THE RELATED ART

Generally, machining processes of automatically manufacturing various products from web-shaped workpieces are widely carried out in factories. For example, such a machining process is employed to manufacture caps to be crimped on both ends of film cartridges which have stored photographic films, 35 mm wide, wound around spools, in a film packaging process.

Specifically, a web-shaped workpiece in the form of a thin metal sheet is inserted into a cap manufacturing apparatus, which is operated while the web-shaped workpiece is being intermittently fed by feed units such as nip rollers. The cap manufacturing apparatus automatically machines the web-shaped workpiece into caps to be crimped on both sides of cartridges.

When caps are manufactured from the web-shaped workpiece, different shapes of unwanted scrap are produced. For example, when pilot holes and burred holes are perforated in the web-shaped workpiece, circular scrap pieces of different diameters are punched out of the web-shaped workpiece. After caps have been manufactured, the web-shaped workpiece is cut off into certain lengths as scrap coils.

Since the various types of scrap and the caps are discharged together from the processing machine, it is a considerably complex task to sort out and collect only the caps. The caps are manually sorted out and collected, and hence cannot efficiently and automatically be obtained.

The film packaging process also employs a barrel plate manufacturing apparatus for manufacturing barrel plates by bending a thin metal sheet. When barrel plates are manufactured from a thin metal sheet, various pieces of scrap and defective barrel plates are also produced. The barrel plate manufacturing apparatus is combined with an apparatus for processing such various pieces of scrap. The cap manufacturing apparatus is also associated with an apparatus for processing various pieces of scrap produced when caps are manufactured.

Since both the barrel plate manufacturing apparatus and the cap manufacturing apparatus are associated with respective scrap processing apparatus, the entire facility is large in size and entails a large amount of cost. These problems manifest themselves particularly when a plurality of barrel plate manufacturing apparatus and a plurality of cap manufacturing apparatus are installed for mass-producing cartridges.

SUMMARY OF THE INVENTION

It is a general object of the present invention to provide a method of and an apparatus for machining a web-shaped workpiece to manufacture various products efficiently and quickly from the web-shaped workpiece.

Another object of the present invention is to provide an apparatus for efficiently processing various pieces of scrap produced from various machining apparatus while effectively simplifying and reducing the size of the entire facility including those apparatus.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
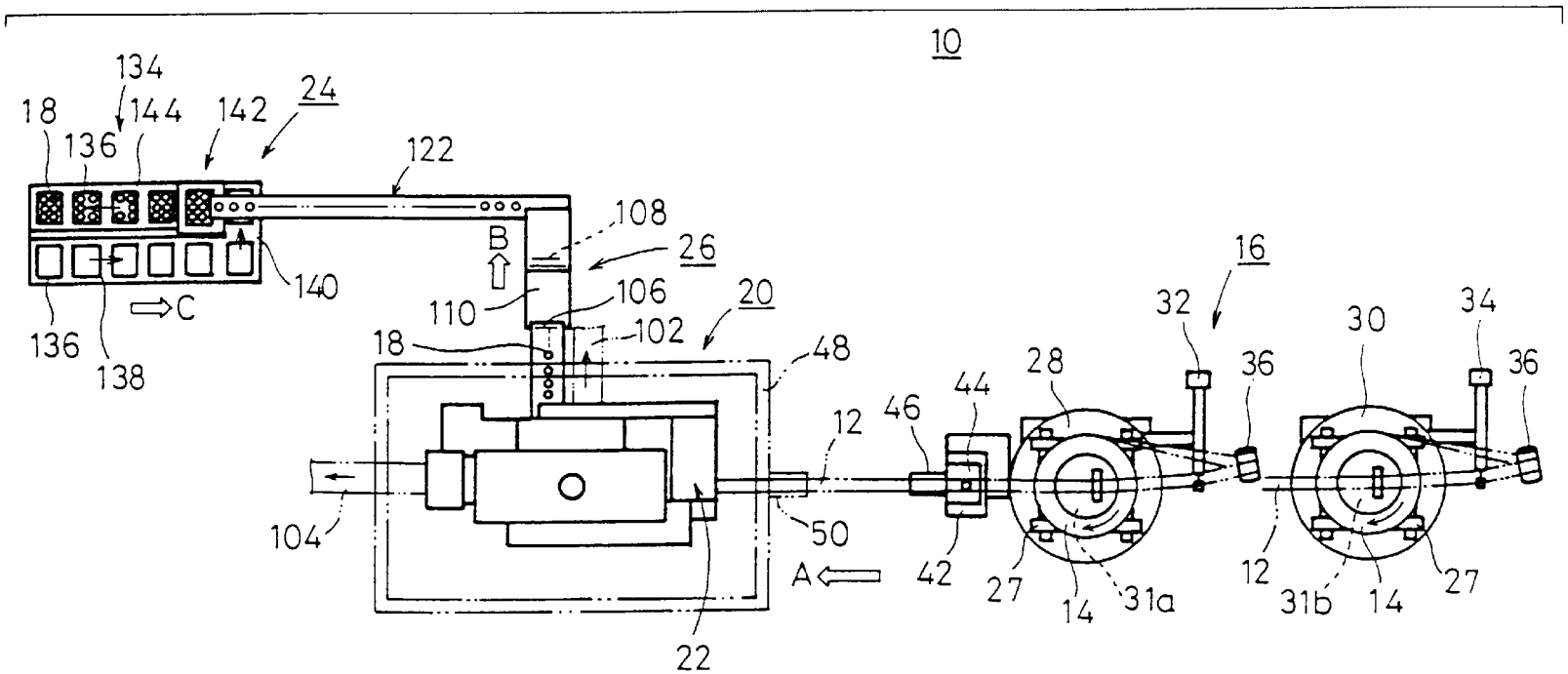
FIG. 1 is a plan view of a machining apparatus according to a first embodiment of the present invention.
Figure 2:
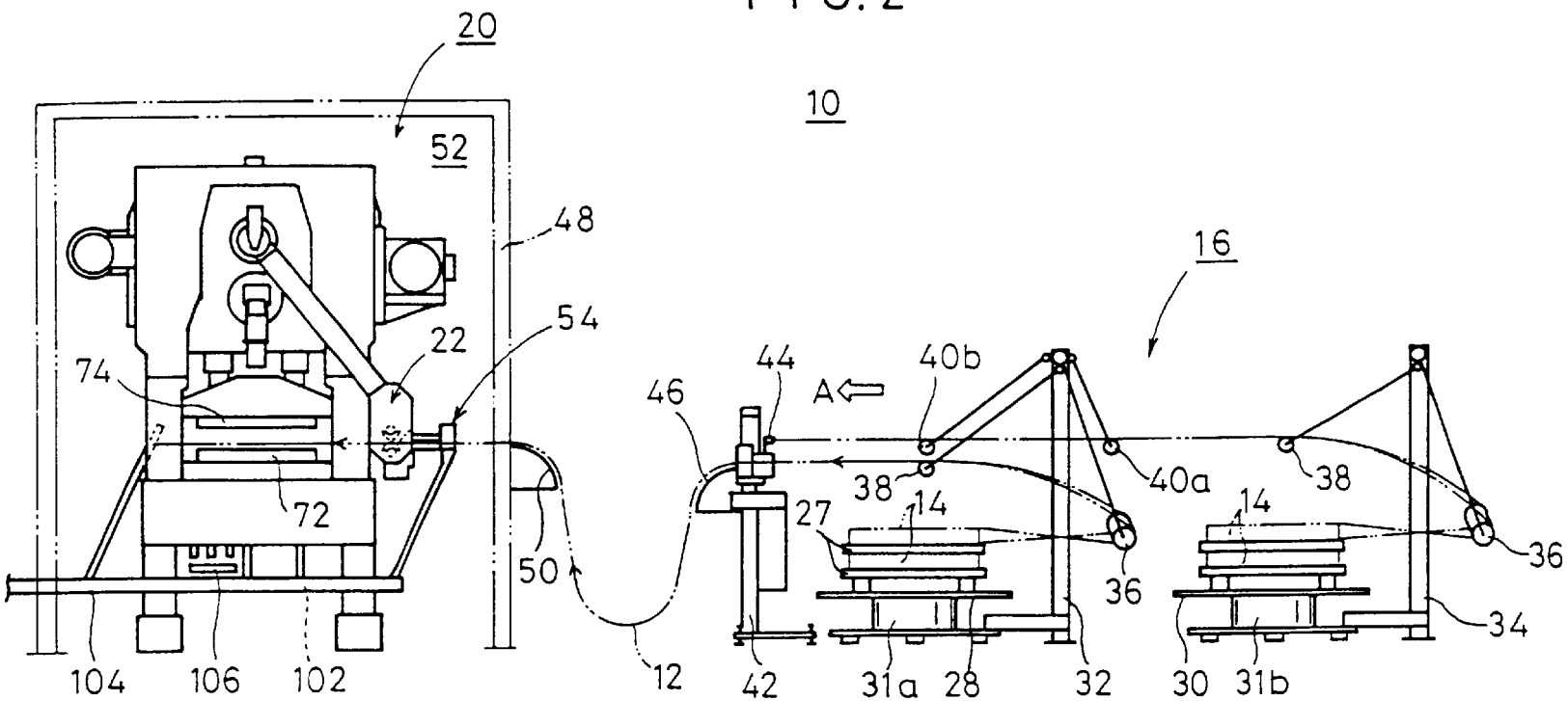
FIG. 2 is a front elevational view of the machining apparatus shown in FIG. 1.

As shown in FIGS. 1 and 2, a machining apparatus 10 according to a first embodiment of the present invention generally comprises a workpiece supply 16 which accommodates workpiece rolls 14 each of a thin metal sheet 12 as an elongate web-shaped workpiece, a processing machine 20 for machining the thin metal sheet 12 into caps 18 as products, a workpiece feeder 22 for feeding the thin metal sheet 12 into the processing machine 20, and a product feeder 26 for automatically separating the caps 18 from scrap and feeding the caps 18 to a product collecting mechanism 24.

The workpiece supply 16 has first and second turntables 28, 30 for supporting a vertical stack of workpiece rolls 14 alternating with bases 27. The first and second turntables 28, 30 are rotatable in the direction indicated by the arrows (see FIG. 1) by respective motors 31*a*, 31*b* (see FIG. 2). The workpiece supply 16 also has first and second posts 32, 34 disposed adjacent respectively to the first and second turntables 28, 30. On the first post 32, there are rotatably mounted a turning roller 36 for changing the orientation of a thin metal sheet 12 unreeled from the first turntable 28 and feeding the thin metal sheet 12 in the direction indicated by the arrow, a guide roller 38 for guiding the thin metal sheet 12, and a pair of guide rollers 40*a*, 40*b* for guiding a thin metal sheet 12 unreeled from the second turntable 30. A turning roller 36, which is identical to the turning roller 36 rotatably mounted on the first post 32, and a guide roller 38, which is identical to the guide roller 38 rotatably mounted on the first post 32, are rotatably mounted on the second post 34.

A mount base 42 is disposed adjacent to the first turntable 28 downstream thereof with respect to the direction in which the thin metal sheet 12 is fed from the workpiece supply 16. A clamp 44 mounted on an upper portion of the mount base 42 serves to grip one of the thin metal sheets 12 unreeled from the first and second turntables 28, 30. A first guide plate 46 that is of an arcuate shape curved from a horizontal direction to a vertically downward direction is fixed to the mount base 42. A second guide plate 50 that is of a similar arcuate shape is fixed to a wall 48 which is horizontally spaced from the first guide plate 46 downstream thereof with respect to the direction in which the thin metal sheet 12 is fed from the workpiece supply 16.

Figure 3:
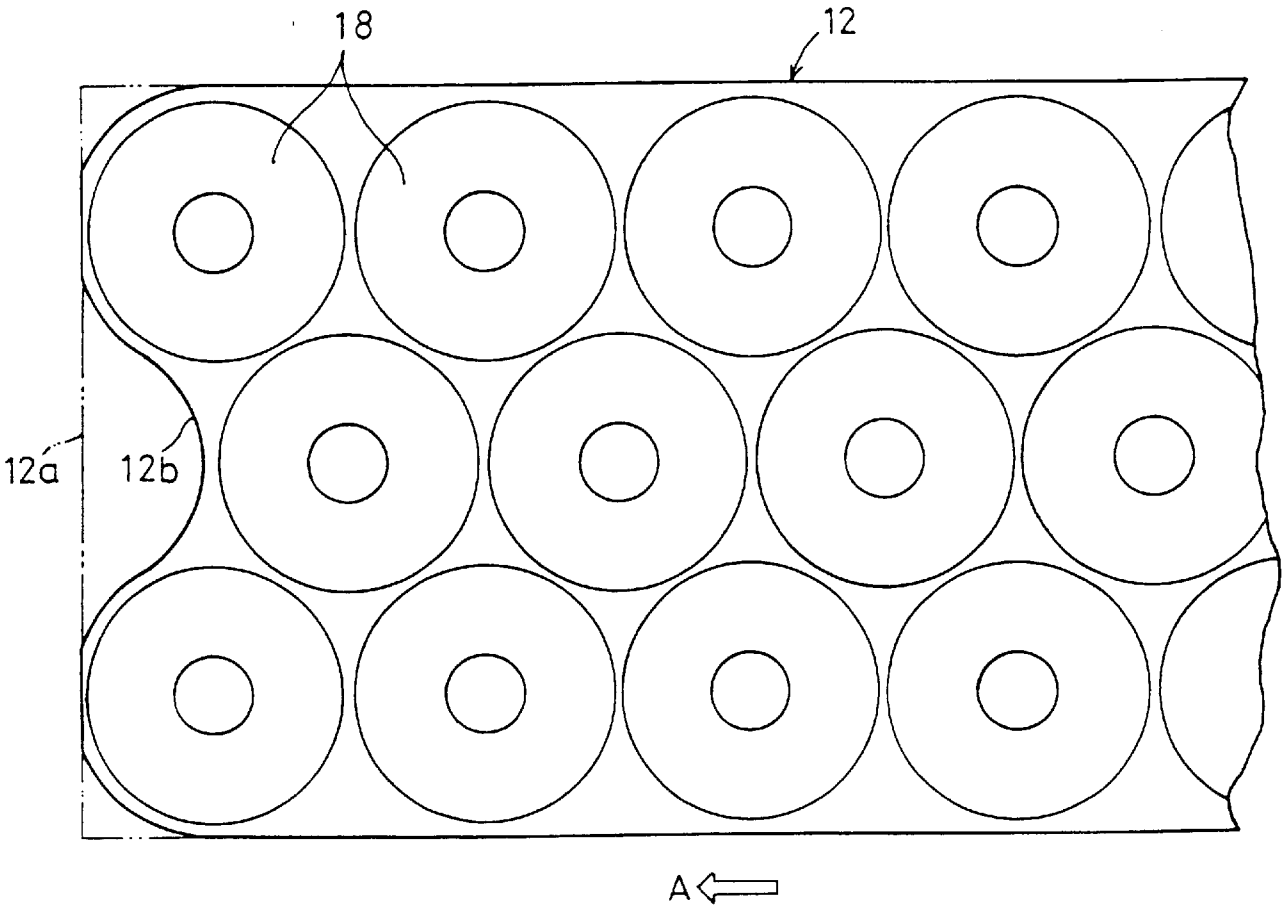
FIG. 3 is a fragmentary plan view of an end portion of a thin metal sheet to be machined by the machining apparatus shown in FIG. 1.

The wall 48 defines a chamber 52 which accommodates the processing machine 20. The workpiece feeder 22 and a scroll cutter 54, which is spaced from the workpiece feeder 22 upstream with respect to the thin metal sheet 12 is fed from the workpiece supply 16 to the processing machine 20, are mounted on the processing machine 20. As shown in FIG. 3, the scroll cutter 54 serves to cut a leading end 12*a* of the thin metal sheet 12 prior to being machined by the processing machine 20, thereby forming a curved edge 12*b* complementary in shape to peripheral shapes of caps 18.

Figure 4:
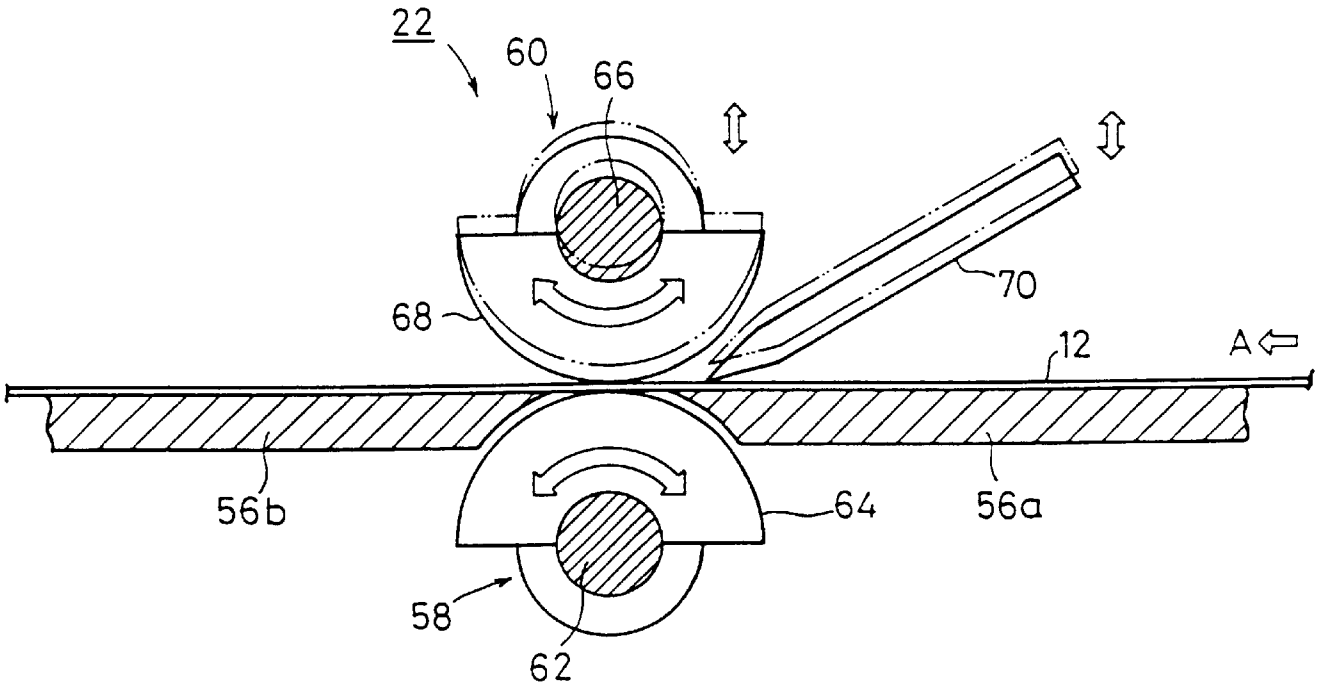
FIG. 4 is a side elevational view, partly in cross section, of a workpiece feeder of the machining apparatus shown in FIG. 1.

As shown in FIG. 4, the workpiece feeder 22 that is located downstream of the scroll cutter 54 has tables 56*a*, 56*b* for guiding a lower surface of the thin metal sheet 12 and lower and upper feeders 58, 60 disposed between the tables 56*a*, 56*b*.

The lower feeder 58 has a rotatable shaft 62 which is rotatable about its own axis in the directions indicated by the arrow, and a semicircular feed face 64 mounted on the rotatable shaft 62. The upper feeder 60 has a rotatable shaft 66 which is rotatable about its own axis in the directions indicated by the arrow and vertically movable in the directions indicated by the arrow, and a semicircular feed face 68 mounted on the rotatable shaft 66 in vertically confronting relation to the feed face 64. A presser 70 inclined to the table 56*a* at a predetermined angle is positioned near the upper feeder 60. The presser 70 is vertically movable toward and away from the table 56*a*.

Figure 7:
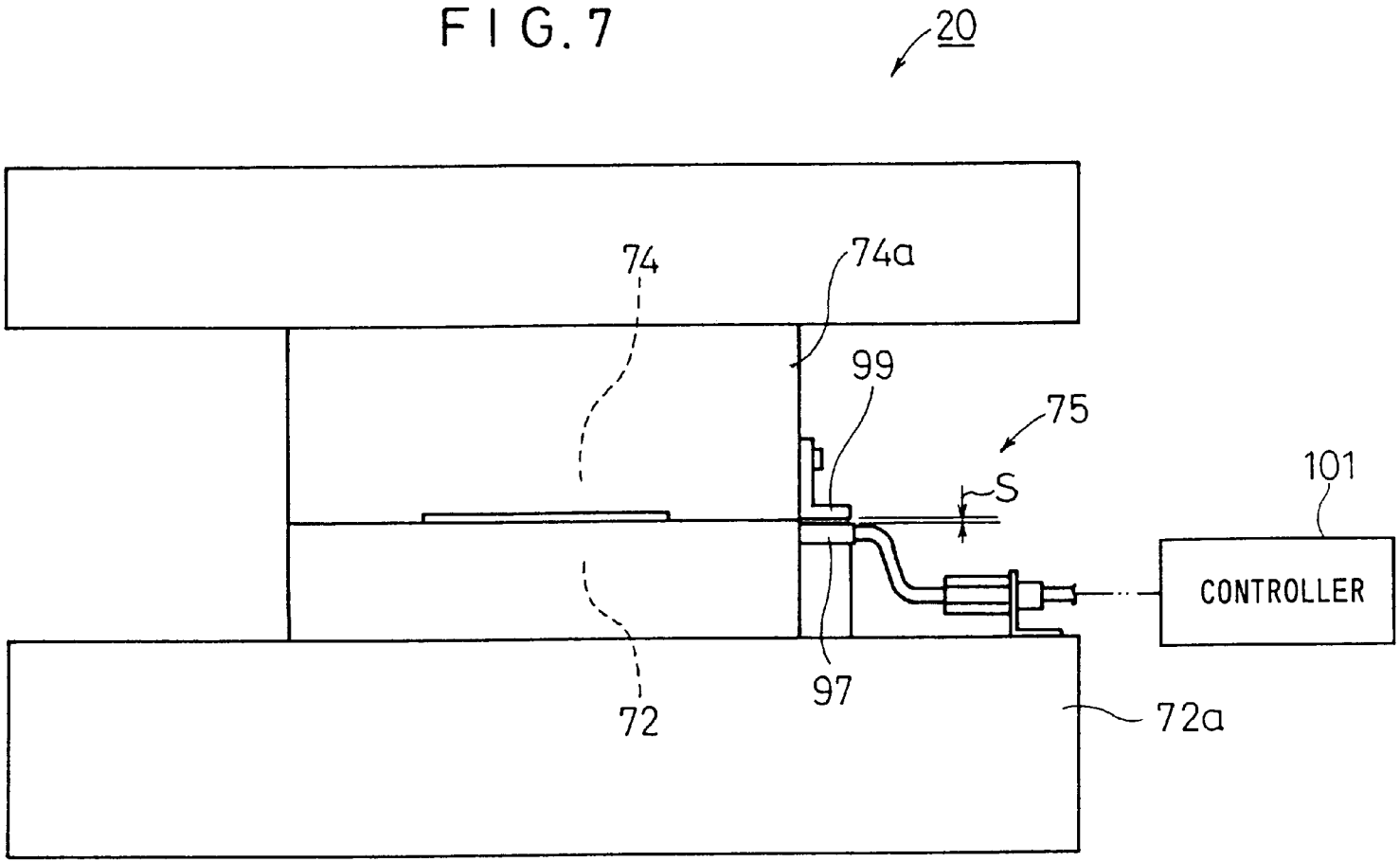
FIG. 7 is a side elevational view of a distance detector incorporated in the machining apparatus shown in FIG. 1.

As shown in FIGS. 2 and 7, the processing machine 20 comprises lower and upper press dies 72, 74 which are vertically movable relatively to each other, and a distance detector 75 for detecting a distance S between the lower and upper press dies 72, 74 when the thin metal sheet 12 is machined by the lower and upper press dies 72, 74 in order to determine whether the thin metal sheet 12 is machined properly or not. The thin metal sheet 12 is successively machined by the lower and upper press dies 72, 74 while the thin metal sheet 12 is intermittently fed a predetermined distance between the lower and upper press dies 72, 74.

Figure 5:
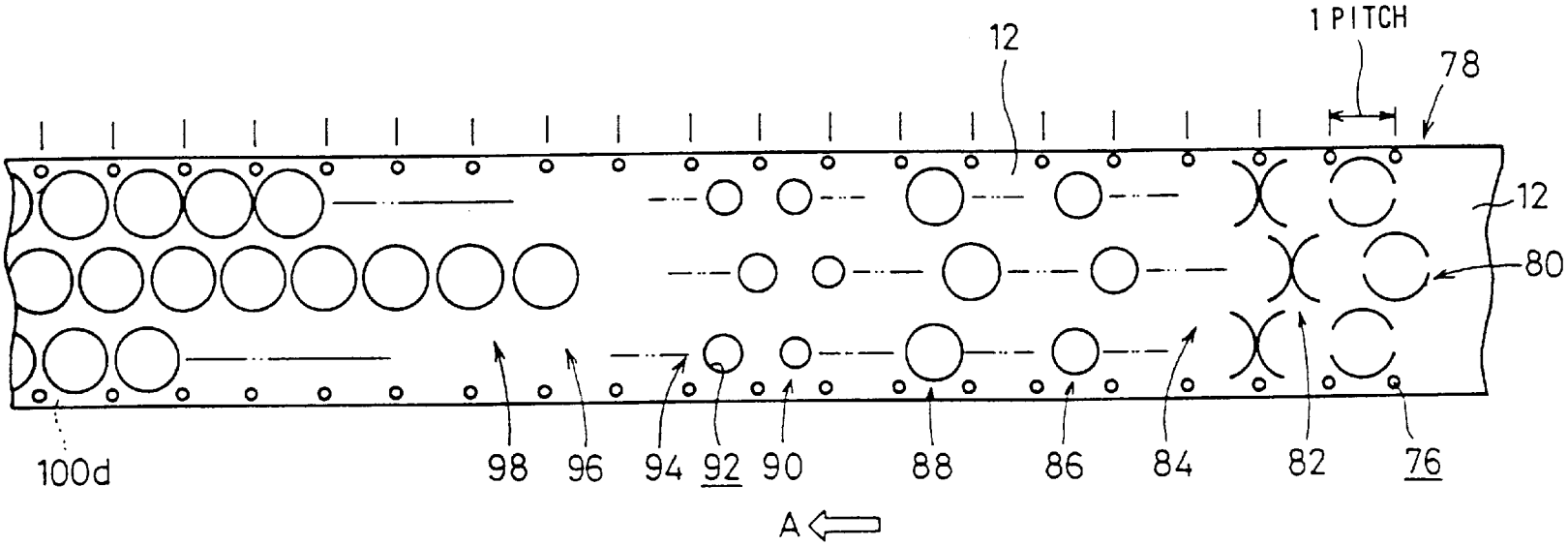
FIG. 5 is a schematic view of machining sections of a processing machine of the machining apparatus shown in FIG. 1.
Figure 6A:
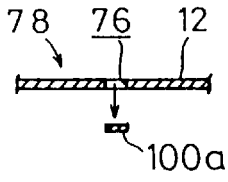
FIG. 6A is a cross-sectional view illustrative of a pilot hole machining section.
Figure 6B:
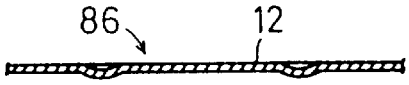
FIG. 6B is a cross-sectional view illustrative of a first forming section.

As shown in FIG. 5, the lower and upper press dies 72, 74 have a pilot hole machining section 78 (see FIG. 6A) for forming pilot holes 76 in opposite marginal edges of the thin metal sheet 12, an inner incising section 80 for incising the thin metal sheet 12 in patterns complementary to caps 18, an outer incising section 82 for incising the thin metal sheet 12 in patterns outside of the incised patterns produced by the inner incising section 80, a stamping section 84 for stamping the thin metal sheet 12, a first forming section 86 (see FIG. 6B), a second forming section 88 (see FIG. 6C), a burred hole machining section 90 (see FIG. 6D) for forming a burred hole 92 in the thin metal sheet 12, a burring section 94 (see FIG. 6E) for forming a flange on the edge of a burred hole 92 produced by the burred hole machining section 90, a drawing section 96 (see FIG. 6F) for cutting off and drawing a cap 18, and a product ejector 98 (see FIG. 6G) for ejecting a cap 18 formed by the drawing section 96. These sections are successively arranged in the direction indicated by the arrow A (see FIG. 5).

As shown in FIG. 7, the distance detector 75 comprises a plurality of (six, for example) metal sensors 97 fixed to a lower die base 72*a* of the lower press die 72, and a plurality of (six, for example) iron-base dogs 99 fixed to an upper die base 74*a* of the upper press die 74. The metal sensors 97 and the iron-base dogs 99 are disposed in confronting pairs. The metal sensors 97 are electrically connected to a controller 101 for supplying signals representative of a detected distance S to the controller 101. Based on the detected distance S, the controller 101 determines whether the thin metal sheet 12 is properly machined by the lower and upper press dies 72, 74 or not.

When the processing machine 20 machines the thin metal sheet 12, it produces a first scrap 100*a* from the pilot hole 76, a second scrap 100*b* from the burred hole 92, a third scrap 100*c* from the drawing section 96, and a fourth scrap 100*d* cut off the thin metal sheet 12 after caps 18 are removed.

Figure 8:
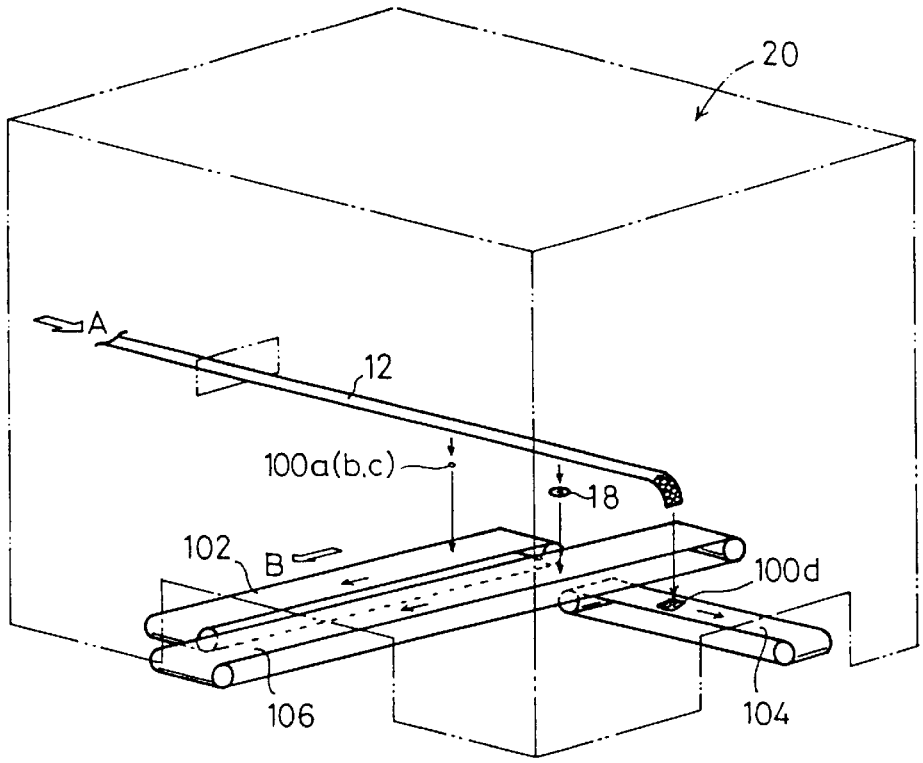
FIG. 8 is a perspective view of a scrap conveyor and a product conveyor incorporated in the machining apparatus shown in FIG. 1.

As shown in FIG. 8, the processing machine 20 has a first scrap conveyor 102 extending in the direction indicated by the arrow B transversely to the direction indicated by the arrow A, for discharging the first, second, third, and fourth scraps 100*a*–100*c* severed from the thin metal sheet 12, and a second scrap conveyor 104 extending in the direction indicated by the arrow A, for discharging the fourth scrap 100*d*, which is coil scrap. The first and second scrap conveyors 102, 104 are coupled to a conveyor (not shown) for automatically conveying the first, second, third, and fourth scraps 100*a*–100*c* to a scrap discharge section (not shown).

The product feeder 26 has a product conveyor 106 (see FIG. 8) disposed in the processing machine 20, for feeding caps 18 produced from the thin metal sheet 12 the product conveyor 106 extends in the direction indicated by the arrow B. An attraction conveyor 110 (see FIG. 9) with an elongate magnet 108 disposed therein is positioned at an end of the product conveyor 106.

Figure 9:
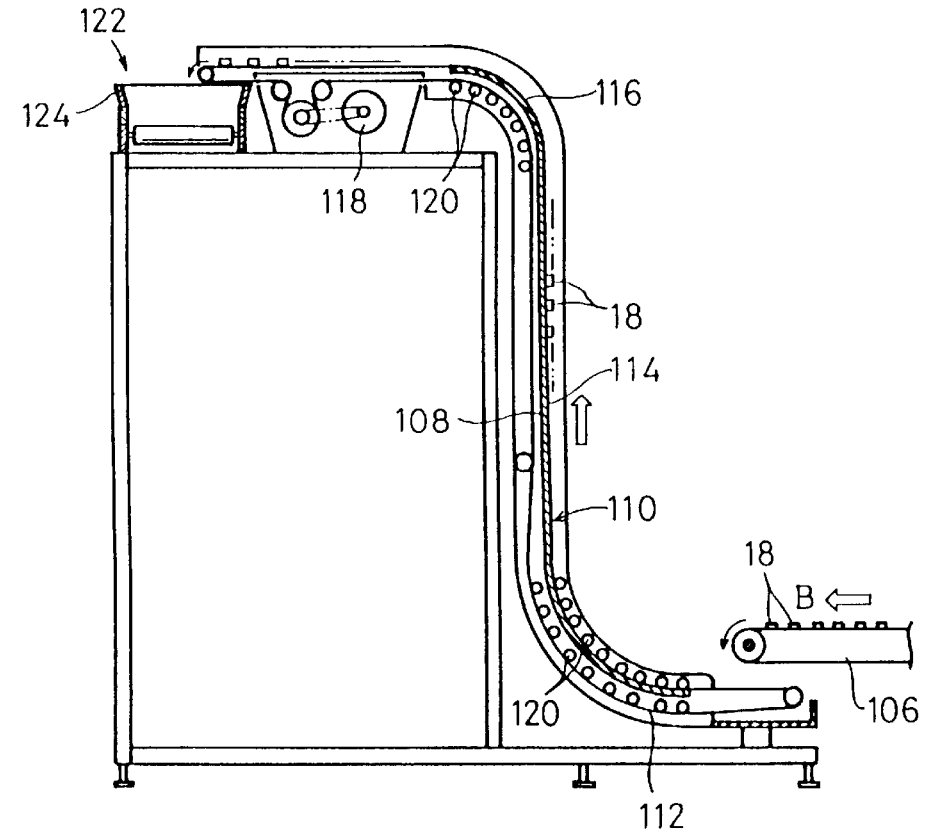
FIG. 9 is a side elevational view of an attraction conveyor of the machining apparatus shown in FIG. 1.

As shown in FIG. 9, the attraction conveyor 110 has a conveyor belt that extends through a first curved portion 112 bent vertically upwardly from a position below the end of the product conveyor 106, a vertical portion 114 extending vertically upwardly, and a second curved portion 116 bent horizontally from an upper end of the vertical portion 114. The conveyor belt of the attraction conveyor 110 is circulatingly operable by a motor 118 disposed in the vicinity of the second curved portion 116. The first and second curved portions 112, 116 have a plurality of guide rollers 120 for guiding the conveyor belt along the curved shapes of the first and second curved portions 112, 116. The magnet 108 is disposed in the looped conveyor belt and extends in the first curved portion 112, the vertical portion 114, and the second curved portion 116.

Figure 10:
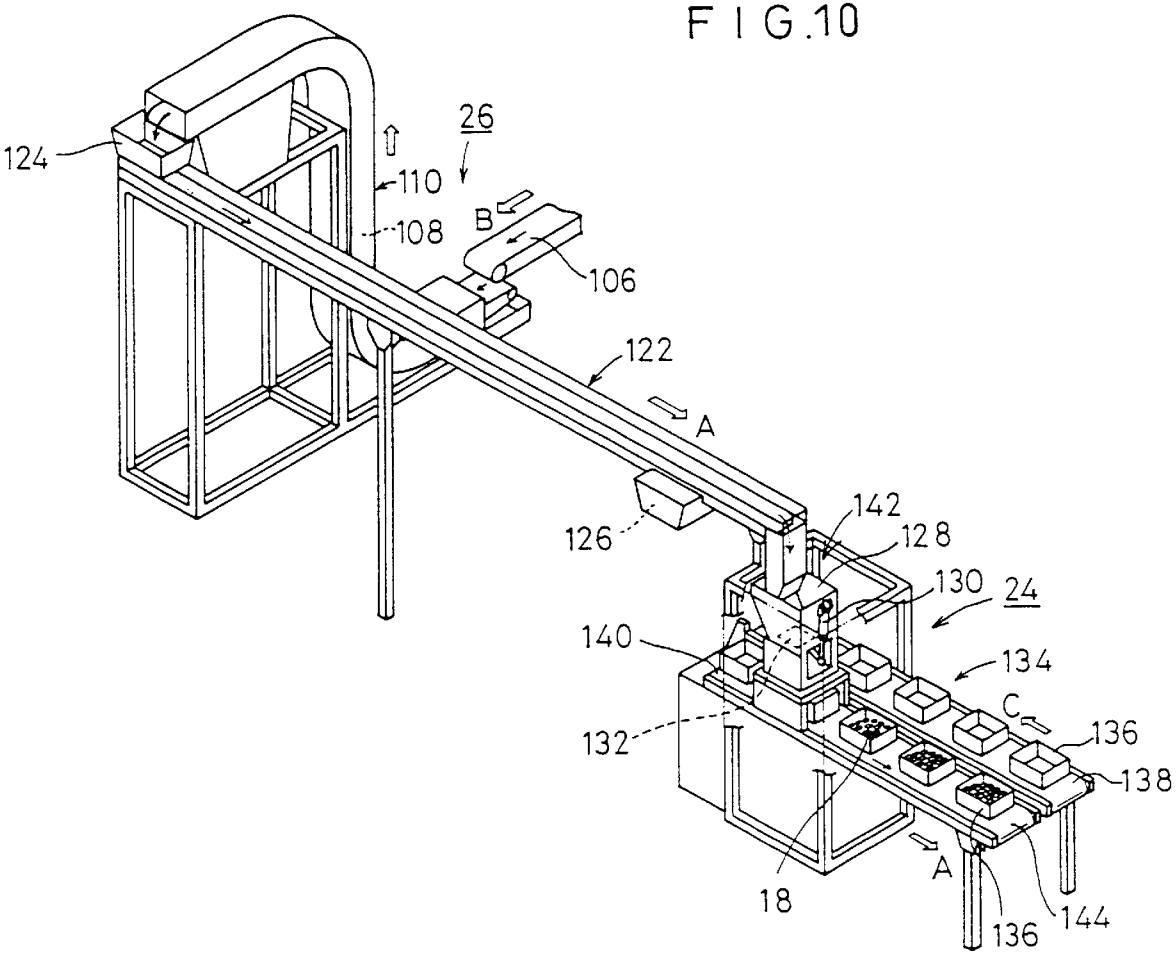
FIG. 10 is a perspective view of an elevated conveyor and a pallet conveyor of the machining apparatus shown in FIG. 1.

An elevated conveyor 122 is disposed near an end of the second curved portion 116 which extends in the direction indicated by the arrow B. The elevated conveyor 122 extends in the direction indicated by the arrow A, and has a bucket 124 for receiving caps 18 from the end of the second curved portion 116. As shown in FIG. 10, the elevated conveyor 122 has a conveyor belt circulatingly operable by a motor 126, and a silo 128 is positioned at an end of the elevated conveyor 122 remotely from the bucket 124. The silo 128 has an openable lid 132 at a lower end thereof.

A pallet conveyor 134 having a substantially C-shaped feed path as viewed in plan is disposed below the silo 128. As shown in FIGS. 1 and 10, the pallet conveyor 134 comprises a roller conveyor 138 for feeding empty containers 136 in the direction indicated by the arrow C, which is opposite to the direction indicated by the arrow A, a motor roller conveyor 140 for feeding empty containers 136 from the roller conveyor 138 in the direction indicated by the arrow B, and a roller conveyor 144 for feeding containers 136 in the direction indicated by the arrow A after the containers 136 have received a predetermined number of caps 18 from the elevated conveyor 122 at a cap collecting position 142.

Operation of the machining apparatus 10 will be described below.

A preparatory process carried out by the worker for making the uppermost workpiece roll 14 on the first turntable 28 ready for use with the processing machine 20 will be described below. The thin metal sheet 12 is unreeled from the uppermost workpiece roll 14, folded over by the turning roller 36 supported on the first post 32, and guided by the guide roller 38 toward the first guide plate 46 fixed to the mount base 42.

The thin metal sheet 12 is then guided by the second guide plate 50 into the chamber 52, whereupon the leading end 12*a* of the thin metal sheet 12 is cut by the scroll cutter 54, forming a curved edge 12*b* in the thin metal sheet 12 (see FIG. 3). The thin metal sheet 12 with the curved edge 12*b* is then inserted between the lower and upper feeders 58, 60 of the workpiece feeder 22.

The preparatory process is now finished, and the machining apparatus 10 starts operating. The first turntable 28 is rotated in the direction indicated by the arrow in FIG. 1 to feed the thin metal sheet 12 unreeled from the uppermost workpiece roll 14. The thin metal sheet 12 thus fed forms a loop between the first and second guide plates 46, 50.

Figure 11A:
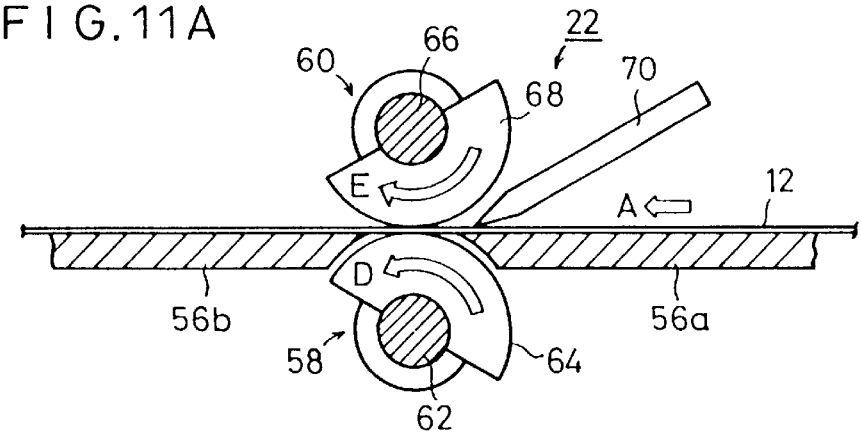
FIG. 11A is a side elevational view, partly in cross section, showing the manner in which the thin metal sheet starts being fed by the workpiece feeder.
Figure 11B:
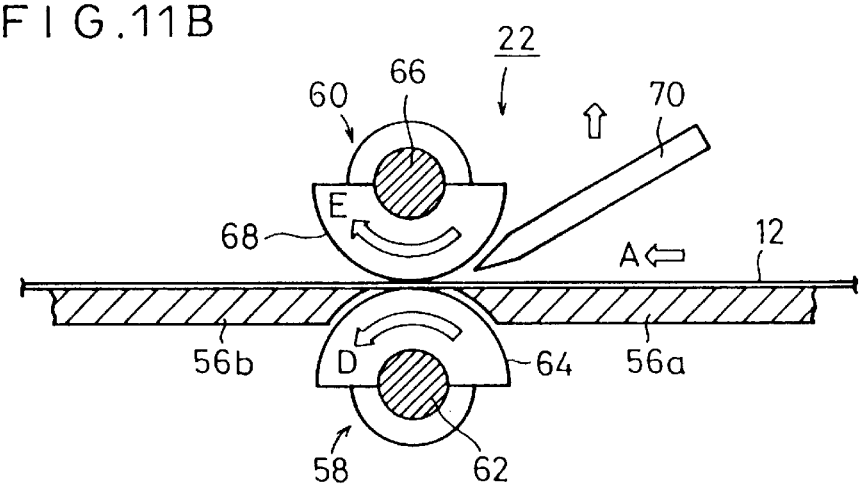
FIG. 11B is a side elevational view, partly in cross section, showing the manner in which the thin metal sheet is being fed by the workpiece feeder.

The rotatable shafts 62, 66 of the lower and upper feeders 58, 60 are synchronously rotated respectively in the directions indicated by the arrows D, E in FIG. 11A, and the presser 70 is moved in a direction away from the thin metal sheet 12. The thin metal sheet 12 is now fed in the direction indicated by the arrow A (see FIG. 11B) while being gripped between the feed faces 64, 68 of the lower and upper feeders 58, 60. The rotatable shafts 62, 66 are stopped after they have rotated a predetermined angle.

Figure 11C:
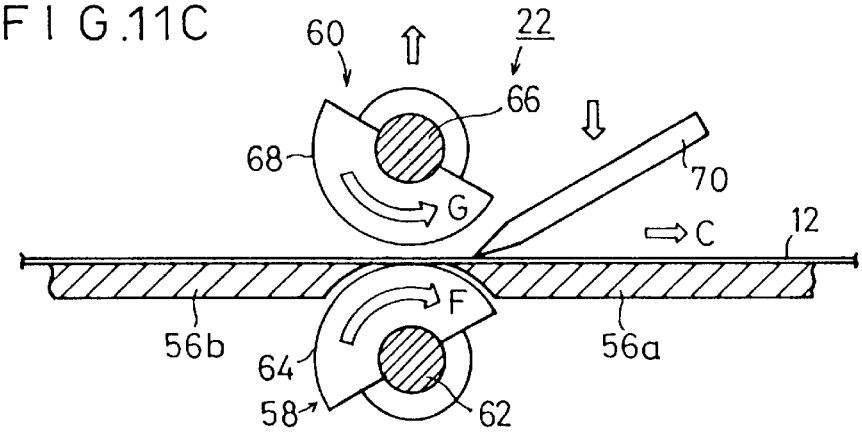
FIG. 11C is a side elevational view, partly in cross section, showing the manner in which the workpiece feeder is returned to its original position.

Then, the rotatable shaft 66 of the upper feeder 60 is moved in a direction away from the thin metal sheet 12, after which the rotatable shafts 62, 66 start rotating in the opposite directions, i.e., in the respective directions indicated by the arrows F, G in FIG. 11C. The presser 70 is moved toward the table 56*a*, gripping the thin metal sheet 12 between the table 56*a* and the tip end of the presser 70. The lower and upper feeders 58, 60 are thus reversed to a predetermined feeding start position without damage to the thin metal sheet 12, and the thin metal sheet 12 is held against movement in the direction indicated by the arrow C because it is gripped between the table 56*a* and the tip end of the presser 70. The above operation of the workpiece feeder 22 is repeated to intermittently feed the thin metal sheet 12 a predetermined distance into the processing machine 20.

In the processing machine 20, the lower and upper press dies 72, 74 move toward and away from each other while the thin metal sheet 20 is being intermittently fed in the direction indicated by the arrow A. As shown in FIG. 5, pilot holes 76 are punched in opposite marginal edges of the thin metal sheet 12 by the pilot hole machining section 78, producing a first scrap 100*a* (see FIG. 6A). Then, the thin metal sheet 12 is incised successively by the inner incising section 80 and the outer incising section 82, and then stamped by the stamping section 84, after which the thin metal sheet 12 is processed by the first forming section 86 (see FIG. 6B).

Figure 6C:
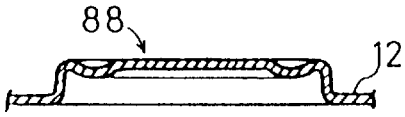
FIG. 6C is a cross-sectional view illustrative of a second forming section.
Figure 6D:
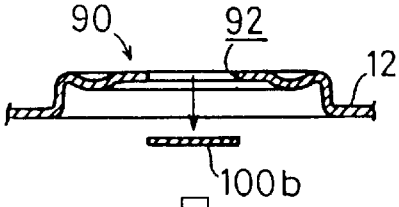
FIG. 6D is a cross-sectional view illustrative of a burred hole machining section.
Figure 6E:
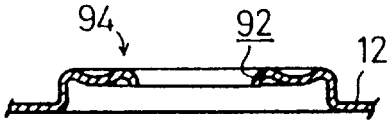
FIG. 6E is a cross-sectional view illustrative of a burring section.
Figure 6F:
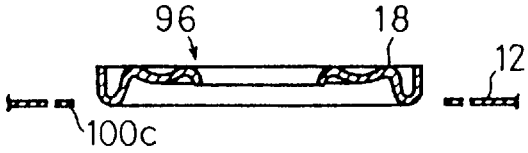
FIG. 6F is a cross-sectional view illustrative of a drawing section.

After having been processed by the first forming section 86, the thin metal sheet 12 is processed by the second forming section 88 (see FIG. 6C). Then, a burred hole 92 is formed in the thin metal sheet 12 by the burred hole machining section 90, producing a second scrap 100*b* (see FIG. 6D). A flange is formed on the edge of the burred hole 92 by the burring section 94 (see FIG. 6E). The drawing section 96 then cuts off and draws a cap 18 (see FIG. 6F), producing a third scrap 100*c*.

Figure 6G:
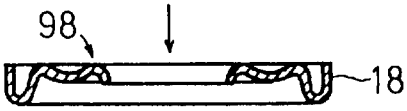
FIG. 6G is a cross-sectional view showing an ejected product.

The thin metal sheet 12 is then fed to the product ejector 98, which removes the cap 18 as a product from the thin metal sheet 12 (see FIG. 6G). Thereafter, the thin metal sheet 12 is cut off into a predetermined length, which is produced as a fourth scrap 100*d*.

When the thin metal sheet 12 is machined by the lower and upper press dies 72, 74 as described above, the distance S between the lower and upper press dies 72, 74 as they are positioned mostly closely to each other is successively detected by the metal sensor 97 and the dog 99 of the distance detector 75, as shown in FIG. 7.

The controller 101 reads the distance S from the metal sensor 97, calculates the difference between the latest distance reading and a preceding distance reading, and also calculates the difference between the latest distance reading and an average value of previous four distance readings. The controller 101 displays a greater distance reading difference on a display monitor unit (not shown). If the greater distance reading difference is larger than a predetermined value, then the controller 101 produces a fault signal. When the fault signal is issued, the worker may shut off the machining apparatus 10 and take necessary actions to remove a fault condition that has caused the greater distance reading difference to be larger than the predetermined value. Accordingly, it is possible to prevent the thin metal sheet 12 from being improperly machined due to chips or other foreign matter introduced into the processing machine 20 or from being improperly fed.

As shown in FIG. 8, the first, second, and third scraps 100*a*–100*c* are delivered to the first scrap conveyor 102 and fed thereby in the direction indicated by the arrow B, and the fourth scrap 100*d* is delivered to the second scrap conveyor 104 and fed thereby in the direction indicated by the arrow A. Thereafter, the first, second, third, and fourth scraps 100*a*–100*d* are delivered to the non-illustrated conveyor, by which they are automatically discharged into the scrap discharge section.

The cap 18 is delivered to the product conveyor 106, which feeds the cap 18 in the direction indicated by the arrow B. As shown in FIG. 9, the cap 18 is then dropped onto the first curved portion 112 of the attraction conveyor 110 whose conveyor belt is being circulatingly moved by the motor 118. The cap 18 supplied to the first curved portion 112 is fed from the first curved portion 112 vertically upwardly along the vertical portion 114 and then horizontally along the second curved portion 116 while being magnetically attracted by the magnet 108.

The cap 18 is then introduced from the horizontal end of the second curved portion 116 into the bucket 124, from which the cap 18 drops onto the end of the elevated conveyor 122 disposed underneath the bucket 124 and whose conveyor belt is being circulatingly moved by the motor 126. As shown in FIG. 10, the cap 18 dropped onto the end of the elevated conveyor 122 is fed in the direction indicated by the arrow A and then supplied from the other end of the elevated conveyor 122 into the silo 128.

On the pallet conveyor 134 disposed beneath the silo 128, an empty container 136 positioned on one end of the roller conveyor 138 is fed thereby in the direction indicated by the arrow C, and transferred to the motor roller conveyor 140. The empty container 136 is fed in the direction indicated by the arrow B by the motor roller conveyor 140, and then fed in the direction indicated by the arrow A into the cap collecting position below the silo 128 by the roller conveyor 144. When the empty container 136 is in the cap collecting position below the silo 128, the lid 132 is opened by a cylinder 130, allowing a predetermined number of caps 18 to fall from the silo 128 into the container 136. After the predetermined number of caps 18 are supplied to the container 136, the container 136 is fed in the direction indicated by the arrow A by the roller conveyor 144, and then unloaded from the end of the roller conveyor 144.

When the remaining length of the thin metal sheet 12 unreeled from the uppermost workpiece roll 14 on the first turntable 28 becomes small, another thin metal sheet 12 unreeled from the uppermost workpiece roll 14 on the second turntable 30 and gripped by the clamp 44 will be supplied to the processing machine 20. While the thin metal sheet 12 unreeled from the first turntable 28 is being machined by the processing machine 20, the thin metal sheet 12 is unreeled from the uppermost workpiece roll 14 on the second turntable 30 and supplied through the turning roller 36 and the guide rollers 38, 40*a*, 40*b* with its leading end gripped by the clamp 44.

When the uppermost workpiece roll 14 on the first turntable 28 is used up, the thin metal sheet 12 gripped by the clamp 44 is quickly fed into the processing machine 20 and machined thereby. During this time, a thin metal sheet 12 is unreeled from a next workpiece roll 14 on the first turntable 28 and its lead end is gripped by the clamp 44.

In the first embodiment, as described above, the workpiece feeder 22 for feeding the thin metal sheet 12 in the direction indicated by the arrow A is positioned upstream of the processing machine 20. For making the thin metal sheet 12 ready for being supplied to the processing machine 20, it is only necessary to unreel the thin metal sheet 12 from the workpiece roll 14, form the curved edge 12*b* in the thin metal sheet 12 with the scroll cutter 54, and then insert the thin metal sheet 12 between the lower and upper feeders 58, 60 of the workpiece feeder 22.

Unlike a feed mechanism disposed downstream of the processing machine 20 for pulling the thin metal sheet 12, the workpiece feeder 22 does not require the worker to insert the thin metal sheet 12 between the lower and upper press dies 72, 74 of the processing machine 20. Accordingly, the preparatory process for preparing the thin metal sheet 12 for supply to the processing machine 20 is highly easy and efficient to perform.

The first, second, third, and fourth scraps 110*a*–11*c* which are produced when the thin metal sheet 12 is machined by the processing machine 20 are discharged onto the first and second scrap conveyors 102, 104, and the cap 18 is delivered onto the product conveyor 106. The cap 18 is then supplied from the product conveyor 106 through the attraction conveyor 110 to the elevated conveyor 122 and the silo 128. In this manner, a predetermined number of caps 18 are automatically collected into the container 136. Consequently, the process of operation from the unreeling of the thin metal sheet 12 to the collection of the caps 18 is carried out automatically and efficiently.

The attraction conveyor 110 which incorporates the magnet 108 makes it possible to feed the cap 18 reliably in various directions, particularly vertically. Therefore, the product collecting mechanism 24 may be positioned as desired, making the machining apparatus 10 adaptable to various layout modifications.

The scroll cutter 54 is disposed upstream of the processing machine 20 for forming the curved edge 12*b* in the leading end 12*a* of the thin metal sheet 12. When the thin metal sheet 12 is machined by the processing machine 20, therefore, no scrap is produced from the leading end 12*a* of the thin metal sheet 12 because of the shape of caps 18. As a result, caps 18 can be produced from the thin metal sheet 12 efficiently with a high yield.

Figure 12:
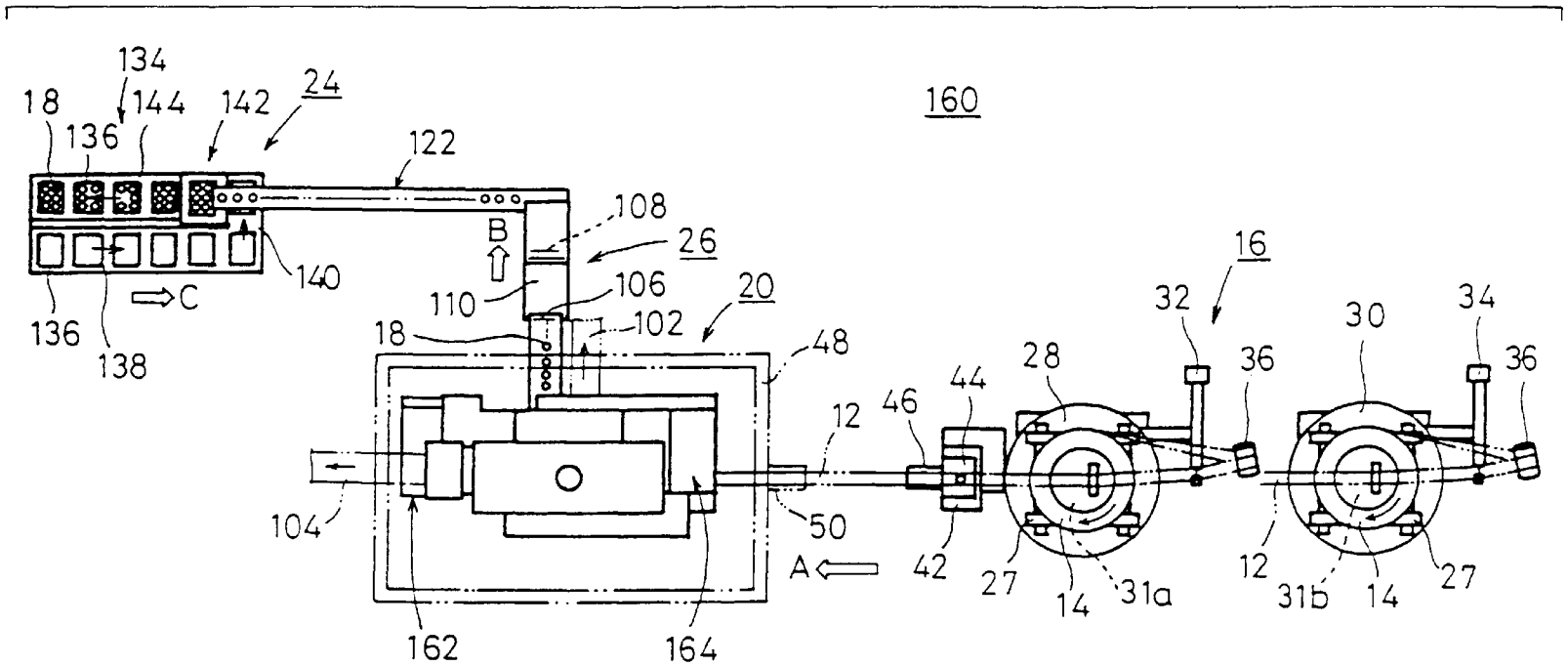
FIG. 12 is a plan view of a machining apparatus according to a second embodiment of the present invention.
Figure 13:
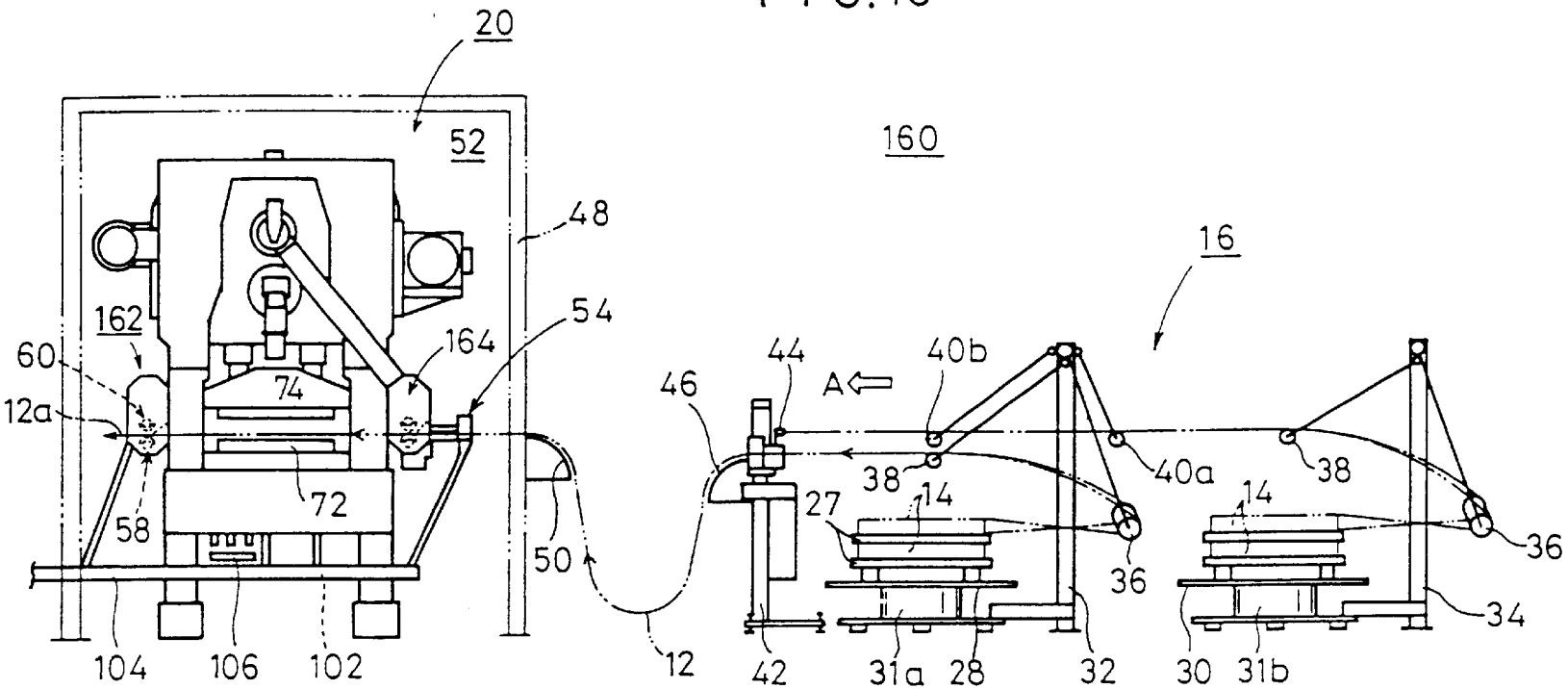
FIG. 13 is a front elevational view of the machining apparatus shown in FIG. 12.

FIGS. 12 and 13 show a machining apparatus 160 according to a second embodiment of the present invention.

As shown in FIGS. 12 and 13, the machining apparatus 160 generally comprises a workpiece supply 16 which accommodates workpiece rolls 14 each of a thin metal sheet 12 as a web-shaped workpiece, a processing machine 20 for machining the thin metal sheet 12 into caps 18 as products, a workpiece feeder 162 disposed downstream of the processing machine 20 with respect to the direction (indicated by the arrow A) in which the thin metal sheet 12 is fed, for feeding the thin metal sheet 12 into the processing machine 20, and a product feeder 26 for automatically separating the caps 18 from scrap and feeding the caps 18 to a product collecting mechanism 24.

The workpiece supply 16, the processing machine 20, and the product feeder 26 shown in FIGS. 12 and 13 are identical to the workpiece supply 16, the processing machine 20, and the product feeder 26 of the machining apparatus 10 according to the first embodiment.

The workpiece feeder 162 is identical to the workpiece feeder 22 according to the first embodiment. A workpiece delivery unit 164 is disposed upstream of the processing machine 20 with respect to the direction indicated by the arrow A, for delivering the thin metal sheet 12 from the processing machine 20 to the workpiece feeder 162. The workpiece delivery unit 164 is identical to the workpiece feeder 22 according to the first embodiment.

Those parts of the machining apparatus 160 which are identical to those of the machining apparatus 10 are denoted by identical reference characters, and will not be described in detail below.

In the machining apparatus 160, the leading end 12*a* of the thin metal sheet 12 unreeled from the workpiece roll 14 on the first turntable 28 is cut off by the scroll cutter 54. Then, the thin metal sheet 12 is inserted between the lower and upper press dies 72, 74 by the workpiece delivery unit 164, and thereafter inserted between the lower and upper feeders 58, 60 of the workpiece feeder 162.

After the preparatory process performed by the worker is finished, the machining apparatus 160 starts operating to machine the thin metal sheet 12. The workpiece feeder 162 is operated to intermittently feed the thin metal sheet 12 through the processing machine 20 while the thin metal sheet 12 is being successively machined by the processing machine 20.

In the second embodiment, various pieces of scrap produced when the thin metal sheet 12 is machined by the processing machine 20 are discharged onto the first and second scrap conveyors 102, 104, and the cap 18 is delivered onto the product conveyor 106. Consequently, the process of operation from the unreeling of the thin metal sheet 12 to the collection of the caps 18 is carried out automatically and efficiently, as is the case with the first embodiment.

According to the second embodiment, furthermore, the processing machine 20 is combined with the workpiece delivery unit 164 disposed upstream of the processing machine 20 for delivering the thin metal sheet 12 into the processing machine 20 and the workpiece feeder 162 disposed downstream of the processing machine 20 for intermittently feeding the thin metal sheet 12 to the processing machine 20. The workpiece delivery unit 164 and the workpiece feeder 162 are jointly effective in smoothly delivering the thin metal sheet 12, which may be highly thin, into the processing machine 20 and also stably and reliably intermittently feeding the thin metal sheet 12.

In the first and second embodiments, the workpiece feeders 22, 162 and the workpiece delivery unit 164 may comprise commercially available air feeders or the like for chucking and intermittently feeding the thin metal sheet 14 in the direction indicated by the arrow A. The scroll cutter 54 may be positioned downstream of the workpiece feeder 22 or the workpiece delivery unit 164, and after the thin metal sheet 12 is gripped by the workpiece feeder 22 or the workpiece delivery unit 164, the leading end 12*a* of the thin metal sheet 12 may be cut off by the scroll cutter 54, and then the thin metal sheet 12 may automatically be delivered into the processing machine 20.

Figure 14:
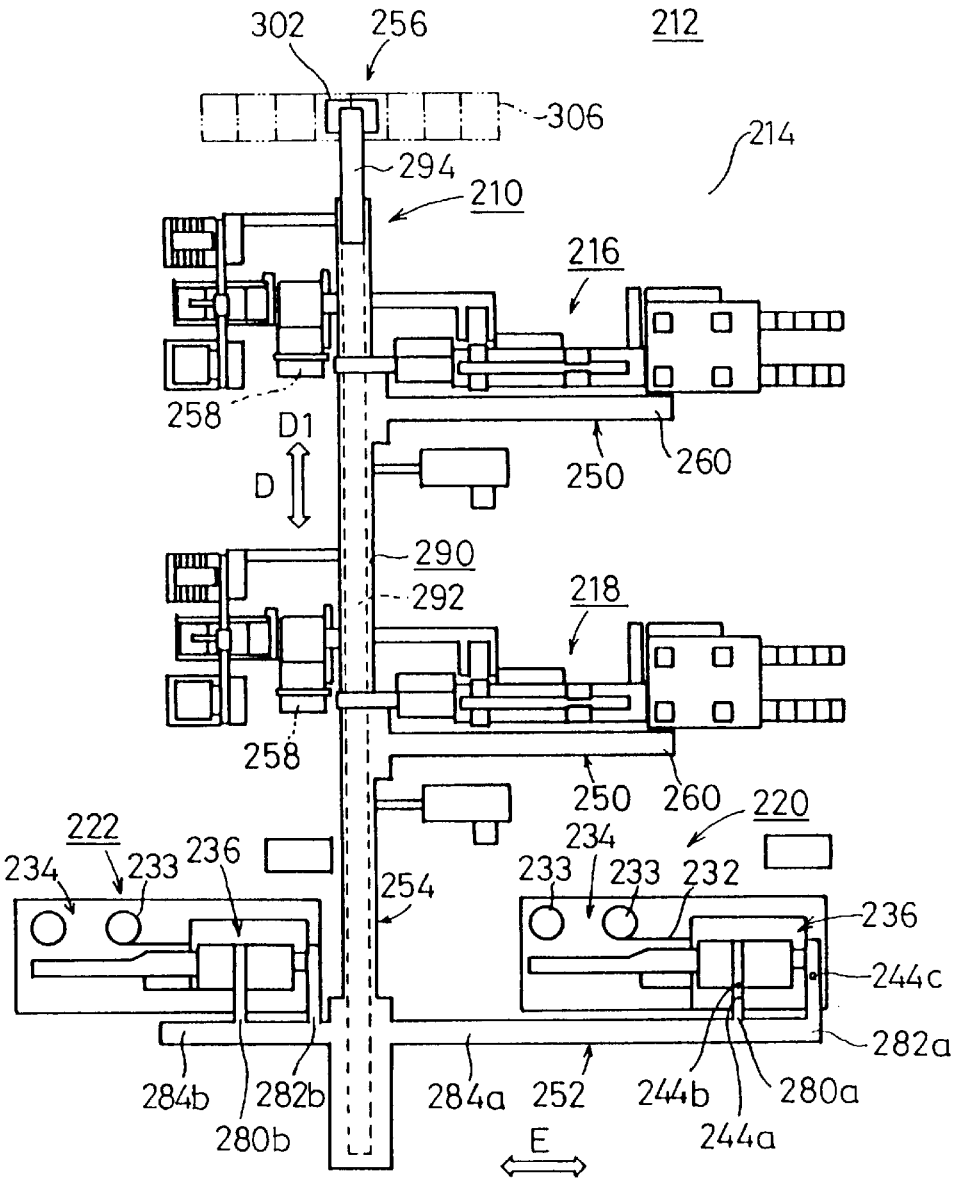
FIG. 14 is a plan view of a parts machining line which incorporates a scrap processing apparatus according to a third embodiment of the present invention.

FIG. 14 shows a parts machining line 212 which incorporates a scrap processing apparatus 210 according to a third embodiment of the present invention.

As shown in FIG. 14, the parts machining line 212 comprises first and second barrel plate manufacturing apparatus 216, 218 (first machining apparatus) juxtaposed on a floor 214 and spaced from each other in the direction indicated by the arrow D, first and second cap manufacturing apparatus 220, 222 (second machining apparatus) juxtaposed on the floor 214 and spaced from each other in the direction indicated by the arrow E transversely to the direction indicated by the arrow D, and the scrap processing apparatus 210.

Figure 15:
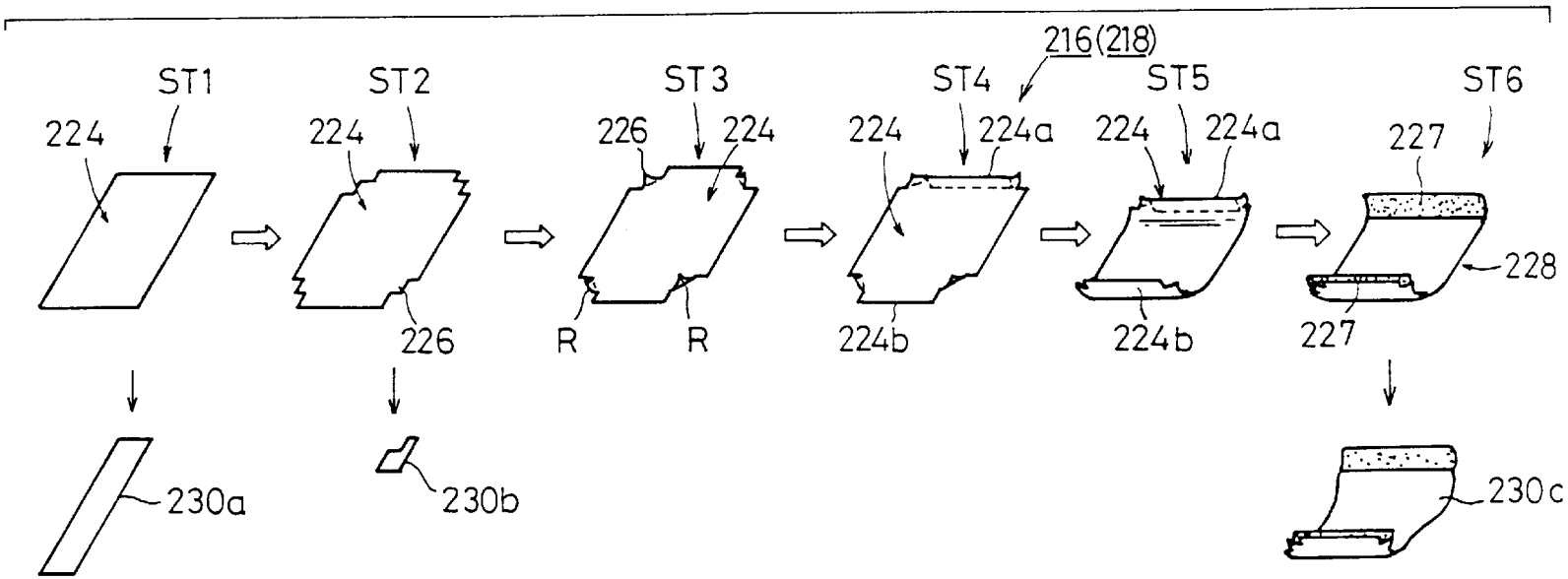
FIG. 15 is a perspective view illustrative of a processing sequence of a barrel plate manufacturing apparatus of the parts machining line shown in FIG. 14.

As shown in FIG. 15, each of the first and second barrel plate manufacturing apparatus 216, 218 comprises a thin sheet supply station ST1, a corner cutting station ST2, a step bending station ST3, an end folding station ST4, an end bending station ST5, and a ribbon-applying station ST6.

The thin sheet supply station ST1 contains a stack of thin metal sheets (first workpiece) 224 to be processed into barrel plates. The thin sheet supply station ST1 supplies one at a time of the stacked thin metal sheets 224. The corner cutting station ST2 cuts off the four corners of the supplied thin metal sheet 224, forming respective steps 226. The step bending station ST3 bends the steps 226 at a small radius R. The end folding station ST4 folds an end 224 of the thin metal sheet 224. The end bending station ST5 bends the folded end 224*a* and an opposite end 224*b* of the thin metal sheet 224 with a press. The ribbon-applying station ST6 applies velveted ribbons 227 respectively to the ends 224*a*, 224*b* of the thin metal sheet 224, producing a barrel plate (first product) 228.

As shown in FIG. 15, when each of the first and second barrel plate manufacturing apparatus 216, 218 produces the barrel plate 228 from the thin metal sheet 224, first, second, and third scraps 230*a*, 230*b*, 230*c* (first scrap member) are generated. The third scrap 230*c* is a barrel plate 228 which is judged as defective and unacceptable by an inspection process after velveted ribbons 227 are applied to the thin metal sheet 224 by the ribbon-applying station ST6.

As shown in FIG. 14, each of the first and second cap manufacturing apparatus 220, 222 comprises a workpiece supply 234 which accommodates workpiece rolls 233 each of a thin metal sheet (second workpiece) 232 as a web-shaped workpiece, and a processing machine 236 for machining the thin metal sheet 232 unreeled from one of the rolls 233.

Figure 16:
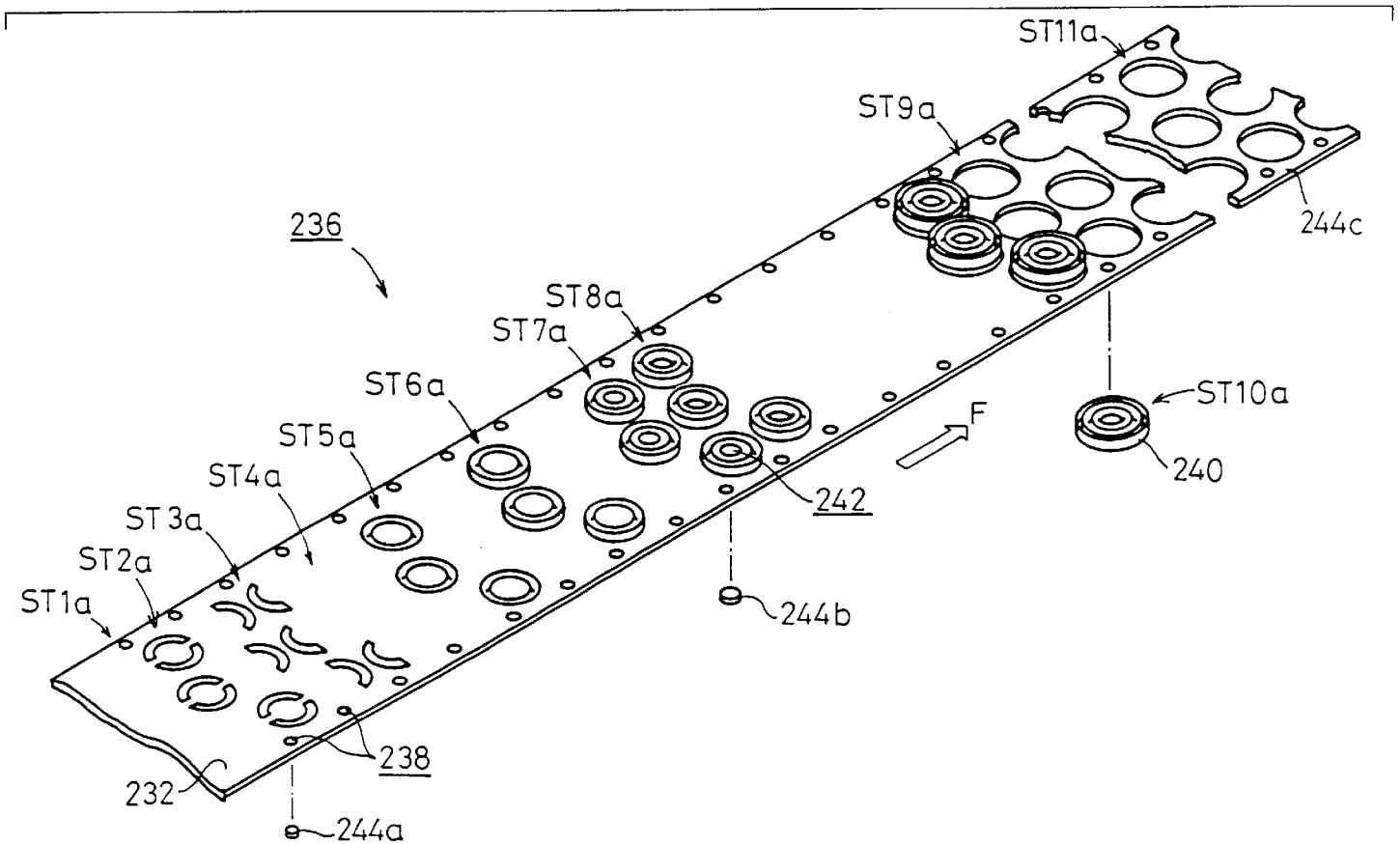
FIG. 16 is a perspective view illustrative of a processing sequence of a cap manufacturing apparatus of the parts machining line shown in FIG. 14.

As shown in FIG. 16, the processing machine 236 comprises a pilot hole machining station ST1*a* for forming pilot holes 238 in opposite marginal edges of the thin metal sheet 232, an inner incising station ST2*a* for incising the thin metal sheet 238 in patterns complementary to caps (second product) 240, an outer incising station ST3*a* for incising the thin metal sheet 232 in patterns outside of the incised patterns produced by the inner incising station ST2*a*, a stamping station ST4*a* for stamping the thin metal sheet 232, a first forming station ST5*a*, a second forming station ST6*a*, a burred hole machining station ST7*a* for forming a burred hole 242 in the thin metal sheet 232, a burring station ST8*a* for forming a flange on the edge of a burred hole 242 produced by the burred hole machining station ST7*a*, a drawing station ST9*a* for cutting off and drawing a cap 240, a product ejecting station ST10*a* for ejecting a cap 240 formed by the drawing station ST9*a*, and a cutting station ST11*a* for cutting off the thin metal sheet 232 into a coil scrap having a predetermined length.

When the pilot hole machining station ST1*a* forms pilot holes 238 in opposite marginal edges of the thin metal sheet 232, the pilot hole machining station ST1*a* produces a fourth scrap (second scrap member) 244*a*. When the burred hole machining station ST7*a* forms a burred hole 242 in the thin metal sheet 232, the burred hole machining station ST7*a* produces a fifth scrap (second scrap member) 244*b*. When the cutting station ST11*a* cuts off the thin metal sheet 232, the cutting station ST11*a* produces a sixth scrap (second scrap member) 244*c* as a coil scrap.

As shown in FIG. 14, the scrap processing apparatus 210 has a pair of first discharge mechanisms 250 extending in the direction indicated by the arrow E along the first and second barrel plate manufacturing apparatus 216, 218, for discharging the first, second, and third scraps 230*a*–230*c* produced by the first and second barrel plate manufacturing apparatus 216, 218, a second discharge mechanism 252 extending in the direction indicated by the arrow E along the first and second cap manufacturing apparatus 220, 222, for discharging the fourth, fifth, and sixth scraps 244*a*–244*c* produced by the first and second cap manufacturing apparatus 220, 222, a feed mechanism 254 for feeding in the direction indicated by the arrow D1 the first, second, and third scraps 230*a*–230*c* and the fourth, fifth, and sixth scraps 244*a*–244*c* which are discharged by the first and second discharge mechanisms 250, 252, and a scrap collecting mechanism 256 for collecting the first, second, and third scraps 230*a*–230*c* and the fourth, fifth, and sixth scraps 244*a*–244*c* which are fed by the feed mechanism 254.

Figure 17:
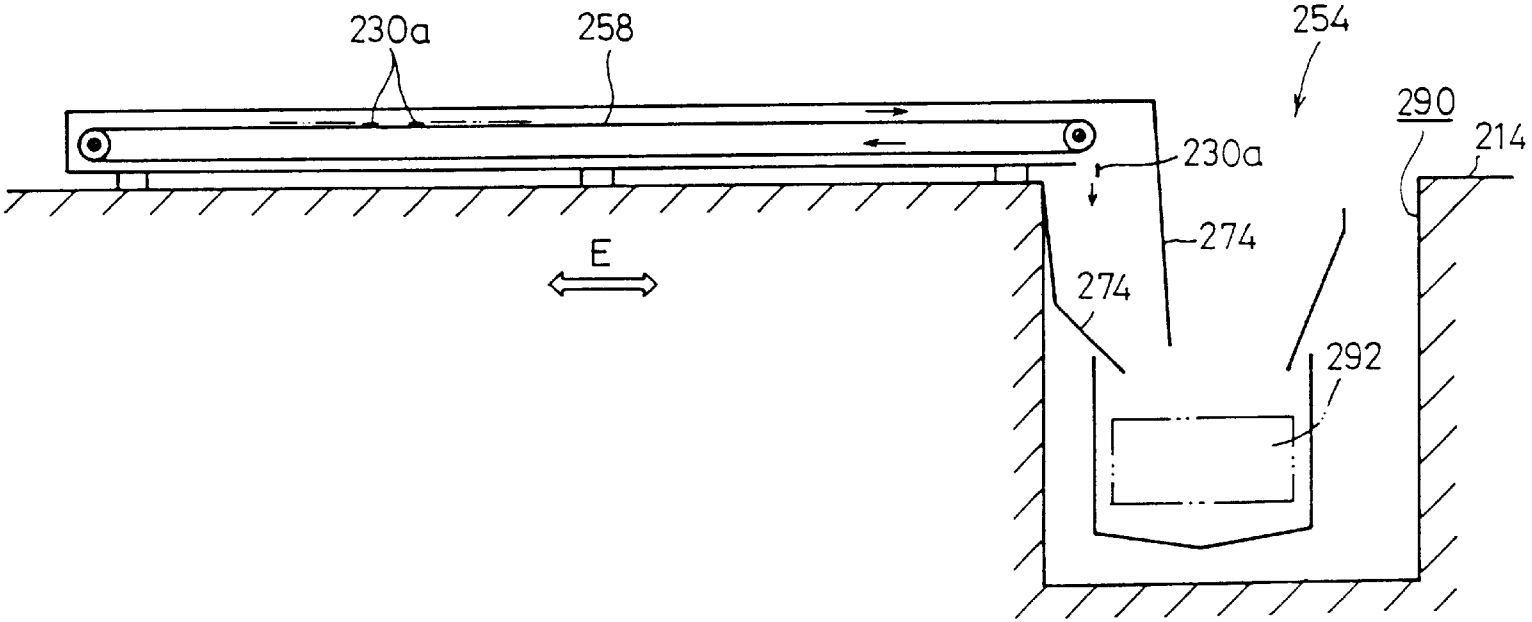
FIG. 17 is a side elevational view, partly in cross section, of a feed mechanism of the scrap processing apparatus and a conveyor in the barrel plate manufacturing apparatus of the parts machining line shown in FIG. 14.
Figure 18:
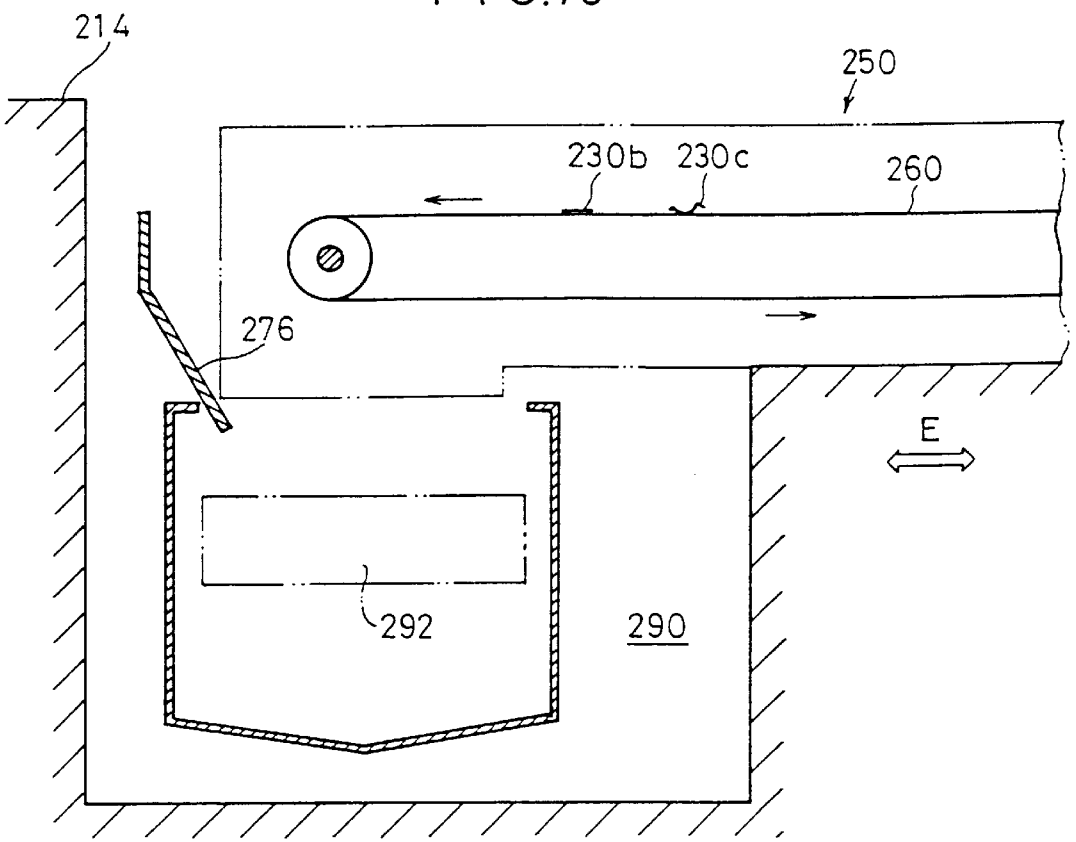
FIG. 18 is a side elevational view, partly in cross section, of the feed mechanism and another conveyor in the barrel plate manufacturing apparatus of the parts machining line shown in FIG. 14.

Each of the first discharge mechanisms 250 comprises a first conveyor 258 for discharging the first scrap 230*a* produced by the first and second barrel plate manufacturing apparatus 216, 218 into the feed mechanism 254, and a second conveyor 260 for discharging the second and third scraps 230*b*, 230*c* into the feed mechanism 254. As shown in FIGS. 17 and 18, guide plates 274, 276 are disposed at ends of the first and second conveyors 258, 260 near the feed mechanism 254 for preventing the first, second, and third scraps 230*a*–230*c* from becoming jammed in feed chains of the feed mechanism 254.

As shown in FIG. 14, the second discharge mechanism 252 comprises third conveyors 280*a*, 280*b* for discharging the fourth and fifth scraps 244*a*, 244*b* from the first and second cap manufacturing apparatus 220, 222, fourth conveyors 282*a*, 282*b* for discharging the sixth scrap 244*c* from the first and second cap manufacturing apparatus 220, 222, and fifth conveyors 284*a*, 284*b* extending in the direction indicated by the arrow E for discharging the fourth, fifth, and sixth scraps 244*a*–244*c* into the feed mechanism 254.

As shown in FIGS. 14, 17–19, the feed mechanism 254 comprises a pit 290 defined in the floor 214, a swing conveyor 292 disposed in the pit 290, and a slanted conveyor 294 extending from an end of the swing conveyor 292 obliquely upwardly toward the scrap collecting mechanism 256.

The swing conveyor 292 extends in the direction indicated by the arrow D from the first and second barrel plate manufacturing apparatus 216, 218 into the first and second cap manufacturing apparatus 220, 222. The slanted conveyor 294 has a circulatory endless conveyor belt 298 and an elongate magnet 300 disposed in the conveyor belt 298. A chute 302 is disposed below an upper end of the slanted conveyor 294, and a movable cart 304 is positioned underneath the chute 302.

Operation of the scrap processing apparatus 210 in relation to the parts machining line 212 will be described below.

In each of the first and second barrel plate manufacturing apparatus 216, 218, as shown in FIG. 15, one at a time of the stacked thin metal sheets 224 is supplied from the thin sheet supply station ST1 to the corner cutting station ST2. In the corner cutting station ST2, the four corners of the supplied thin metal sheet 224 are cut off, forming respective steps 226 and discharging second scraps 230*b*. The thin metal sheet 224 with the steps 226 is fed to the step bending station ST3. In the step bending station ST3, the steps 226 are bent at a small radius R.

The thin metal sheet 224 is then delivered from the step bending station ST3 to the end folding station ST4. After the end 224*a* of the thin metal sheet 224 is folded in the end folding station ST4, the thin metal sheet 224 is supplied to the end bending station ST5. In the end bending station ST5, the ends 224*a*, 224*b* of the thin metal sheet 224 are bent by a press. If the thin metal sheet 224 machined by the end bending station ST5 is judged as acceptable by an inspection process, then the thin metal sheet 224 is sent to the ribbon-applying station ST6. In the ribbon-applying station ST6, velveted ribbons 227 are applied to the respective ends 224*a*, 224*b* of the thin metal sheet 224. If the thin metal sheet 224 machined by the end bending station ST5 is judged as defective, then the thin metal sheet 224 is ejected as the third scrap 230*c*.

While the barrel plate 228 is being manufactured in each of the first and second barrel plate manufacturing apparatus 216, 218, the second and third scraps 230*b*, 230*c* and the first scrap 230*a* that is produced when the thin metal sheet 224 is formed to desired shape are generated in a large quantity.

As shown in FIGS. 14 and 17, the first scrap 230*a* is delivered to the feed mechanism 254 by the first conveyor 258, and discharged onto the swing conveyor 292 of the feed mechanism 254 by being guided by the guide plates 274. As shown in FIG. 18, the second and third scraps 230*b*, 230*c* are discharged from the second conveyor 260 onto the swing conveyor 292 by being guided by the guide plate 276.

In each of the first and second cap manufacturing apparatus 220, 222, the thin metal sheet 232 is fed from one of the workpiece rolls 233 in the workpiece supply 234 to the processing machine 236. In the processing machine 236, as shown in FIG. 16, the thin metal sheet 232 is intermittently fed in the direction indicated by the arrow F. In the pilot hole machining station ST1*a*, pilot holes 238 are formed in opposite marginal edges of the thin metal sheet 232, producing a fourth scrap 244*a*.

Then, the thin metal sheet 232 is machined successively by the inner incising station ST2*a*, the outer incising station ST3*a*, and the stamping station ST4*a*, after which the thin metal sheet 232 is processed by the first forming station ST5*a*. After having been processed by the first forming station ST5*a*, the thin metal sheet 232 is processed by the second forming station ST6*a*. Then, the thin metal sheet 232 is fed to the burred hole machining station ST7*a*, in which a burred hole 242 is formed in the thin metal sheet 232, producing a fifth scrap 244*b*.

A flange is formed on the edge of the burred hole 242 by the burring station ST8*a*. The thin metal sheet 232 is fed to the drawing station ST9*a* which cuts off and draws a cap 240. In the product ejecting station ST10*a*, the cap 240 is removed from the thin metal sheet 232. Thereafter, the thin metal sheet 232 is cut off into a predetermined length as a sixth scrap 244*c* by the cutting station ST11*a*.

As shown in FIG. 14, the fourth and fifth scraps 244*a*, 244*b* are discharged via the third conveyors 280*a*, 280*b* onto the fifth conveyors 284*a*, 284*b*, and the sixth scrap 244*c* is discharged via the fourth conveyors 282*a*, 282*b* onto the fifth conveyors 284*a*, 284*b*. The fourth, fifth, and sixth scraps 244*a*–244*c* are discharged from the fourth conveyors 282*a*, 282*b* onto the swing conveyor 292 of the feed mechanism 254.

Figure 19:
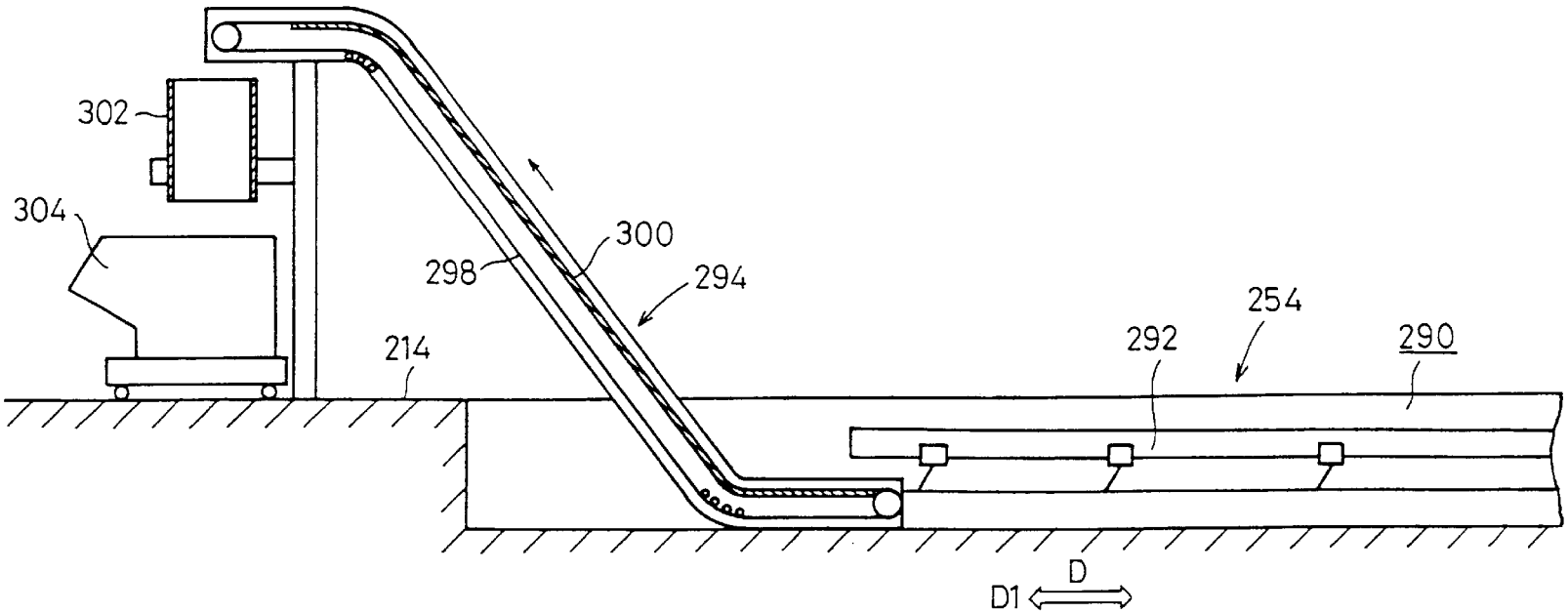
FIG. 19 is a front elevational view of the feed mechanism of the parts machining line shown in FIG. 14.

The swing conveyor 292 feeds the first, second, and third scraps 230*a*–230*c* and the fourth, fifth, and sixth scraps 244*a*–244*c* in the direction indicated by the arrow D1 toward the scrap collecting mechanism 256, and then, as shown in FIG. 19, delivers the first, second, and third scraps 230*a*–230*c* and the fourth, fifth, and sixth scraps 244*a*–244*c* onto the slanted conveyor 294 disposed closely to the end of the swing conveyor 292. The first, second, and third scraps 230*a*–230*c* and the fourth, fifth, and sixth scraps 244*a*–244*c* which are supplied to the slanted conveyor 294 are fed obliquely upwardly by the endless belt 298 while being magnetically attracted by the magnet 300, and then dropped from the upper end of the slanted conveyor 294 into the chute 302.

The chute 302 has a manual distribution chute (not shown) which discharges a predetermined number of the first, second, and third scraps 230*a*–230*c* and the fourth, fifth, and sixth scraps 244*a*–244*c* into the movable cart 304 that is positioned below the chute 302. When the loaded movable cart 304 is moved away from the position below the chute 302, another empty movable cart 304 is moved into the position below the chute 302.

In the third embodiment, the feed mechanism 254 is integrally combined through the first and second discharge mechanisms 250, 252 with the first and second barrel plate manufacturing apparatus 216, 218 which manufacture barrel plates 228 and the first and second cap manufacturing apparatus 220, 222 which manufacture caps 240. The first, second, and third scraps 230*a*–230*c* produced by the first and second barrel plate manufacturing apparatus 216, 218 and the fourth, fifth, and sixth scraps 244*a*–244*c* produced by the first and second cap manufacturing apparatus 220, 222 are delivered by the swing conveyor 292 of the common feed mechanism 254 toward the scrap collecting mechanism 256, and then collected into the movable cart 304 removably placed in the scrap collecting mechanism 256.

As described above, the scrap processing apparatus 210 is capable of processing both the first, second, and third scraps 230*a*–230*c* produced by the first and second barrel plate manufacturing apparatus 216, 218 and the fourth, fifth, and sixth scraps 244*a*–244*c* produced by the first and second cap manufacturing apparatus 220, 222. Consequently, the parts machining line 212 is smaller in size, simpler in structure, and lower in cost than conventional parts machining lines where the first and second barrel plate manufacturing apparatus 216, 218 and the first and second cap manufacturing apparatus 220, 222 would need respective dedicated scrap processing apparatus.

Furthermore, the single feed mechanism 254 is shared by the first and second barrel plate manufacturing apparatus 216, 218 and the first and second cap manufacturing apparatus 220, 222. The entire facility is thus relatively small in size, and capable of processing scrap efficiently with ease.

In the third embodiment, moreover, the swing conveyor 292 of the feed mechanism 254 is disposed in the pit 290 defined in the floor 214. This layout provides an extra space above the swing conveyor 292, which can effectively be used for another purpose in the factory in which the parts machining line 212 is installed. The slanted conveyor 294, which is joined to the end of the swing conveyor 292 near the scrap collecting mechanism 256, feeds the first, second, and third scraps 230*a*–230*c* and the fourth, fifth, and sixth scraps 244*a*–244*c* to an upper position in the factory, from which the first, second, and third scraps 230*a*–230*c* and the fourth, fifth, and sixth scraps 244*a*–244*c* are dropped into the movable cart 304 in the scrap collecting mechanism 256. The movable cart 304 can easily be handled because it is only required to be removably positioned in the scrap collecting mechanism 256 on the floor 214.

In the third embodiment, the scrap processing apparatus 210 is integrally combined with the first and second barrel plate manufacturing apparatus 216, 218 (first machining apparatus) and the first and second cap manufacturing apparatus 220, 222 (second machining apparatus). However, the scrap processing apparatus 210 may be integrally combined with first through Nth (N=an integer of 3 or more) machining apparatus.

Figure 20:
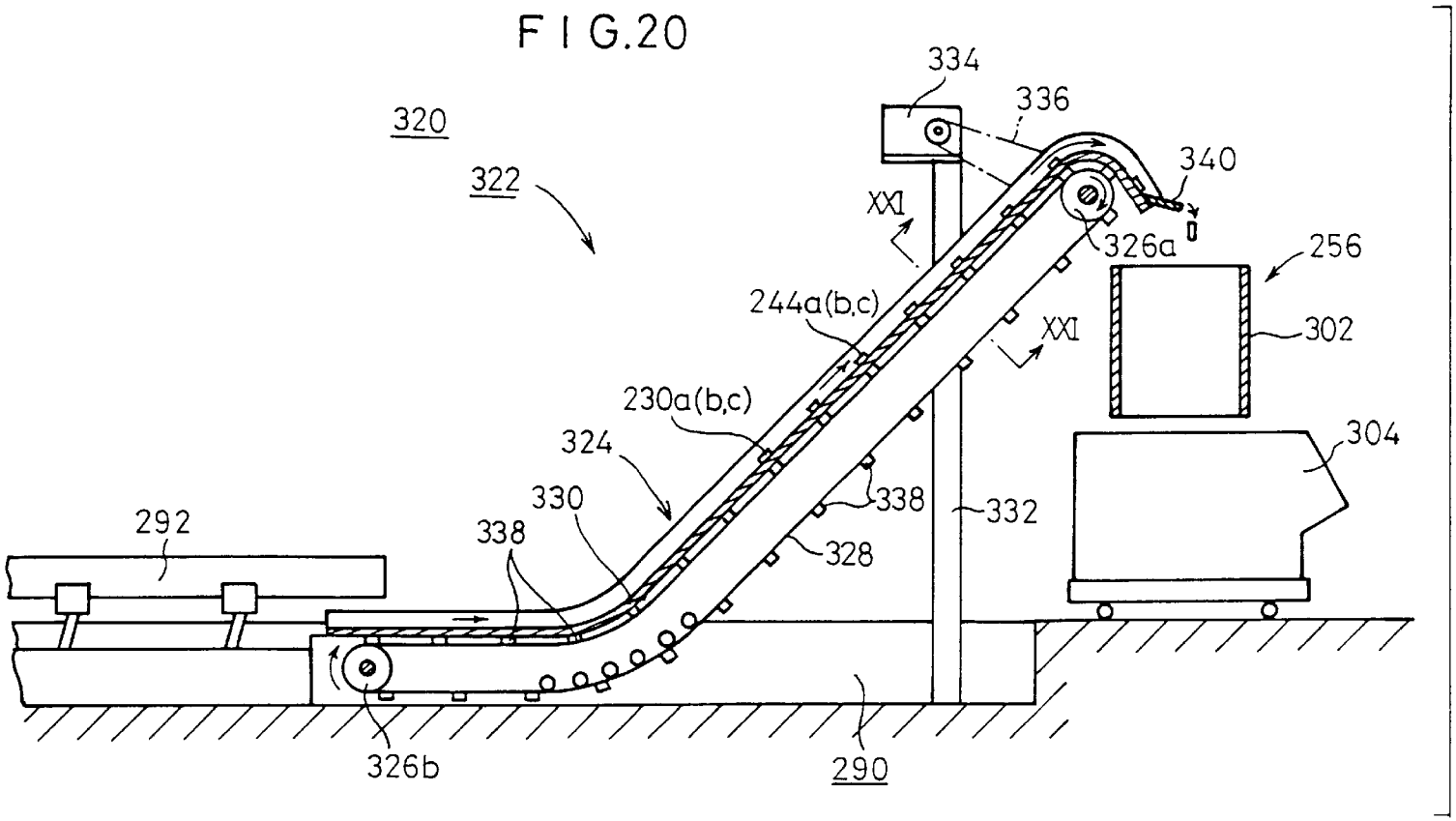
FIG. 20 is a front elevational view of a feed mechanism of a scrap processing apparatus according to a fourth embodiment of the present invention.
Figure 21:
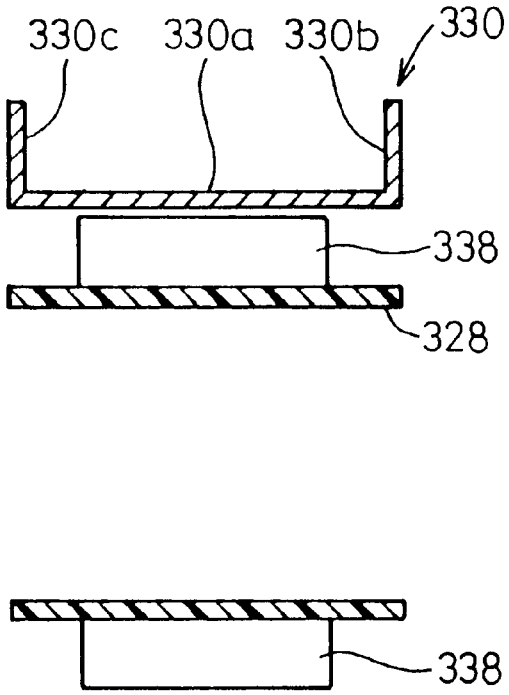
FIG. 21 is a cross-sectional view taken along line XXI—XXI of FIG. 20.

FIGS. 20 and 21 show a feed mechanism 322 of a scrap processing apparatus 320 according to a fourth embodiment of the present invention. Those parts of the scrap processing apparatus 320 which are identical to the scrap processing apparatus 210 according to the third embodiment are denoted by identical reference characters, and will not be described in detail below.

As shown in FIG. 20, the feed mechanism 322 has a slanted conveyor 324 extending from an end of the swing conveyor 292 in the pit 290 obliquely upwardly toward the scrap collecting mechanism 256. The slanted conveyor 324 comprises an endless belt 328 circulatingly movably trained around pulleys 326*a*, 326*b*, and a passage member 330 extending over the endless belt 328 and serving as a scrap feed path. A motor 334 is supported on a post 332 above an upper end of the slanted conveyor 324. The motor 334 has a rotatable shaft operatively connected to the pulley 326*a* by a chain and sprocket mechanism 336.

A plurality of magnets 338 are mounted at spaced intervals on an outer peripheral surface of the endless belt 328. The magnets 338 are movable with the endless belt 328 obliquely upwardly along the lower surface of the passage member 330 closely thereto. The passage member 330 comprises an elongate plate of stainless steel (SUS), and extends above and along the endless belt 328 from the end of the swing conveyor 292 to the scrap collecting mechanism 256. As shown in FIG. 21, the passage member 330 is of a substantially channel cross section and has a feed surface 330*a* along which scrap will be fed and a pair of guide surfaces 330*b*, 330*c* extending perpendicularly to respective opposite side edges of the feed surface 330*a*. As shown in FIG. 20, a scraper blade 340 is positioned near the upper end of the passage member 330 for removing scrap from the passage member 330.

The feed mechanism 322 operates as follows: The first, second, and third scraps 230*a*–230*c* and the fourth, fifth, and sixth scraps 244*a*–244*c* are delivered from the swing conveyor 292 onto the passage member 330 of the slanted conveyor 324. The endless belt 328 of the slanted conveyor 324 is circulatingly operated by the motor 334 through the chain and sprocket mechanism 336, moving the magnets 338 with the endless belt 328 obliquely upwardly along the lower surface of the passage member 330 closely thereto.

Therefore, the first, second, and third scraps 230*a*–230*c* and the fourth, fifth, and sixth scraps 244*a*–244*c* supplied onto the passage member 330 are fed obliquely upwardly along the feed surface 330*a* while being magnetically attracted by the magnets 338. At the upper end of the slanted conveyor 324, the first, second, and third scraps 230*a*–230*c* and the fourth, fifth, and sixth scraps 244*a*–244*c* are caused by the scraper blade 340 to fall off the end of the passage member 330 into the chute 302 that is positioned therebelow.

Since the first, second, and third scraps 230*a*–230*c* and the fourth, fifth, and sixth scraps 244*a*–244*c* are fed along the feed surface 330*a* of the passage member 330, they are prevented from being introduced into the endless belt 328. The guide surfaces 330*b*, 330*b* on the opposite sides of the feed surface 330*a* are effective to prevent the first, second, and third scraps 230*a*–230*c* and the fourth, fifth, and sixth scraps 244*a*–244*c* from dropping off the side edges of the slanted conveyor 324.

As described above, the machining apparatus for machining the elongate web-shaped workpiece according to the present invention machines the elongate web-shaped workpiece unreeled from the workpiece supply with the machining sections or stations to manufacture products, and automatically separates the products from scrap and feeds the products with the product feeder to the product collecting mechanism. Therefore, only desired products can automatically and efficiently be produced from the elongate web-shaped workpiece.

Furthermore, the scrap processing apparatus according to the present invention has the single feed mechanism for feeding first and second scraps from the first and second machining apparatus altogether to the scrap collecting mechanism. The first and second machining apparatus do not need to be combined with respective dedicated scrap processing apparatus. The entire facility of the scrap processing apparatus is thus relatively simple in structure and small in size, and can process the scraps efficiently.

Although certain preferred embodiments of the present invention have been shown and described in detail, it should be understood that various changes and modifications may be made therein without departing from the scope of the appended claims.

What is claimed is:

1. An apparatus for machining a web-shaped workpiece, comprising:

a workpiece supply for supplying an elongate web-shaped workpiece;

a processing machine for machining the elongate web-shaped workpiece supplied from said workpiece supply into a product;

a workpiece feeder for feeding said elongate web-shaped workpiece to said processing machine, said workpiece feeder being disposed downstream of said processing machine with respect to the direction which the elongate web-shaped workpiece is fed to said processing machine; and a product feeder for separating the product from scrap and feeding the product to a product collecting mechanism.

2. An apparatus according to claim 1, further comprising a workpiece delivery unit disposed upstream of said processing machine, for delivering the elongate web-shaped workpiece from said processing machine to said workpiece feeder.

3. An apparatus according to claim 1, further comprising a cutter disposed upstream of said processing machine, for machining a leading end of the elongate web-shaped workpiece in a pattern complementary to the shape of the product in order to prevent scrap from being produced from the leading end of the elongate web-shaped workpiece when the elongate web-shaped workpiece is machined by the processing machine.

4. An apparatus according to claim 1, wherein said workpiece supply comprises:

first and second turntables each for carrying a coil of the elongate web-shaped workpiece; and a clamp for gripping the elongate web-shaped workpiece unreeled from one of said first and second turntables when the elongate web-shaped workpiece unreeled from the other of said first and second turntables is fed to said processing machine.

5. An apparatus according to claim 1, further comprising:

a scrap feeder for discharging scrap discharged from said processing machine.

6. An apparatus according to claim 1, wherein said product feeder comprises:

a conveyor for feeding said product from said processing machine; and an attraction conveyor having magnets for magnetically attracting and feeding said product from said conveyor to said product collecting mechanism.

7. An apparatus according to claim 1, wherein said processing machine comprises:

a pair of lower and upper dies vertically movable relatively toward and away from each other, for machining said elongate web-shaped workpiece; and a distance detector for detecting a value corresponding to a distance between said lower and upper dies when said elongate web-shaped workpiece is machined by said lower and upper dies.

8. An apparatus for machining a web-shaped workpiece, comprising:

a workpiece supply for supplying an elongate web-shaped workpiece;

a processing machine for machining the elongate web-shaped workpiece supplied from said workpiece supply into a product;

a workpiece feeder that nips and feeds said elongate web-shaped workpiece to said processing machine, said workpiece feeder being disposed downstream of said processing machine with respect to the direction in which the elongate web-shaped workpiece is fed to said processing machine; and a product feeder for separating the product from scrap and feeding the product to a product collecting mechanism.

9. The apparatus according to claim 8, wherein said workpiece feeder intermittently nips and feeds said elongate web-shaped workpiece to said processing machine.

10. An apparatus for machining a web-shaped workpiece, comprising:

a workpiece supply for supplying an elongate web-shaped workpiece;

a processing machine for machining the elongate web-shaped workpiece supplied from said workpiece supply into a product;

means for feeding said elongate web-shaped workpiece to said processing machine, said means being disposed downstream of said processing machine with respect to the direction in which the elongate web-shaped workpiece is fed to said processing machine; and a product feeder for separating the product from scrap and feeding the product to a product collecting mechanism.

* * * * *